US009178256B2

(12) United States Patent
Stephanou et al.

(10) Patent No.: US 9,178,256 B2
(45) Date of Patent: Nov. 3, 2015

(54) ISOTROPICALLY-ETCHED CAVITIES FOR EVANESCENT-MODE ELECTROMAGNETIC-WAVE CAVITY RESONATORS

(75) Inventors: Philip Jason Stephanou, Mountain View, CA (US); Sang-June Park, San Diego, CA (US); Ravindra V. Shenoy, Dublin, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 334 days.

(21) Appl. No.: 13/451,385

(22) Filed: Apr. 19, 2012

(65) Prior Publication Data

US 2013/0278609 A1 Oct. 24, 2013

(51) Int. Cl.
*H01P 1/207* (2006.01)
*H01P 7/06* (2006.01)
(Continued)

(52) U.S. Cl.
CPC ..... *H01P 1/208* (2013.01); *H01P 1/2084* (2013.01); *H01P 7/06* (2013.01); *H01P 11/007* (2013.01); *H01P 11/008* (2013.01); *H01P 1/202* (2013.01); *H01P 7/04* (2013.01)

(58) Field of Classification Search
CPC ..... H01P 1/202; H01P 1/208; H01P 1/2088; H01P 7/04; H01P 7/06; H01P 7/065
USPC ..... 333/207, 209, 210, 224, 232
See application file for complete search history.

(56) References Cited

U.S. PATENT DOCUMENTS 4,292,610 A 9/1981 Makimoto et al.
5,188,983 A 2/1993 Guckel et al.
(Continued)

FOREIGN PATENT DOCUMENTS

CN 1416605 A 5/2003
CN 1819331 A 8/2006
(Continued)

OTHER PUBLICATIONS

Liu et al. (2010) "High-*Q* Tunable Microwave Cavity Resonators and Filters Using SOI-Based RF MEMS Tuners" *Journal of Microelectromechanical Systems* 19(4):774-784.
(Continued)

*Primary Examiner* — Robert Pascal
*Assistant Examiner* — Gerald Stevens
(74) *Attorney, Agent, or Firm* — Weaver Austin Villeneuve & Sampson LLP

(57) ABSTRACT

This disclosure provides implementations of electromechanical systems (EMS) resonator structures, devices, apparatus, systems, and related processes. In one aspect, a device includes an evanescent-mode electromagnetic-wave cavity resonator. In some implementations, the resonator includes an isotropically-etched cavity operable to support one or more evanescent electromagnetic wave modes. In some implementations, the resonator also includes a cavity ceiling arranged to form a volume in conjunction with the isotropically-etched cavity. In some implementations, the resonator also includes a capacitive tuning structure having a portion that is located at least partially within the volume so as to support the evanescent electromagnetic wave modes. In some implementations, a distal surface of the tuning structure is separated from the closest surface to it by a gap distance, a resonant electromagnetic wave mode of the cavity resonator being dependent at least partially on the gap distance.

25 Claims, 29 Drawing Sheets

(51) Int. Cl.

| | |
|---|---|
| ***H01P 1/208*** | (2006.01) |
| ***H01P 11/00*** | (2006.01) |
| *H01P 1/202* | (2006.01) |
| *H01P 7/04* | (2006.01) |

(56) References Cited

U.S. PATENT DOCUMENTS

| | | | | |
|---|---|---|---|---|
| 5,329,687 | A * | 7/1994 | Scott et al. | 29/527.2 |
| 5,682,128 | A * | 10/1997 | Huang | 335/216 |
| 5,777,534 | A | 7/1998 | Harrison | |
| 6,064,895 | A | 5/2000 | Baumfalk et al. | |
| 7,429,334 | B2 | 9/2008 | Tung et al. | |
| 7,449,979 | B2 | 11/2008 | Koh et al. | |
| 7,456,711 | B1 | 11/2008 | Goldsmith | |
| 7,463,121 | B2 * | 12/2008 | D'Ostilio | 333/223 |
| 7,586,239 | B1 | 9/2009 | Li et al. | |
| 7,586,393 | B2 | 9/2009 | Tilmans et al. | |
| 7,659,150 | B1 | 2/2010 | Monadgemi et al. | |
| 7,742,220 | B2 | 6/2010 | Kogut et al. | |
| 7,836,574 | B2 | 11/2010 | Jafri et al. | |
| 7,875,944 | B2 | 1/2011 | Higashi et al. | |
| 7,965,251 | B2 | 6/2011 | Hesselbarth | |
| 7,982,560 | B2 | 7/2011 | Hesselbarth | |
| 8,299,878 | B2 | 10/2012 | Pardo et al. | |
| 8,598,969 | B1 * | 12/2013 | Walker et al. | 333/209 |
| 2001/0002809 | A1 * | 6/2001 | Haapakoski | 333/222 |
| 2003/0102943 | A1 | 6/2003 | Beis et al. | |
| 2005/0046524 | A1 | 3/2005 | Sasaki | |
| 2006/0132264 | A1 | 6/2006 | Hoft et al. | |
| 2007/0119258 | A1 | 5/2007 | Yee | |
| 2008/0067948 | A1 | 3/2008 | Hesselbarth | |
| 2008/0116999 | A1 | 5/2008 | Park et al. | |
| 2008/0252401 | A1 | 10/2008 | Margomenos et al. | |
| 2009/0128263 | A1 | 5/2009 | Hesselbarth | |
| 2009/0189487 | A1 | 7/2009 | Nishigaki et al. | |
| 2010/0007442 | A1 * | 1/2010 | Narhi | 333/188 |
| 2010/0050768 | A1 | 3/2010 | Takeyama | |
| 2010/0107387 | A1 | 5/2010 | Song et al. | |
| 2010/0321132 | A1 | 12/2010 | Park | |
| 2011/0193657 | A1 | 8/2011 | Gautier et al. | |
| 2011/0241802 | A1 | 10/2011 | Joshi et al. | |
| 2013/0278359 | A1 | 10/2013 | Stephanou et al. | |
| 2013/0278610 | A1 | 10/2013 | Stephanou et al. | |
| 2013/0278998 | A1 | 10/2013 | Stephanou et al. | |

FOREIGN PATENT DOCUMENTS

| | | | |
|---|---|---|---|
| CN | 101425788 | A | 5/2009 |
| EP | 1469548 | B1 | 11/2008 |
| EP | 2056394 | A1 | 5/2009 |
| EP | 2337149 | A1 | 6/2011 |
| JP | S64-78503 | | 3/1989 |
| JP | H05-80001 | U | 10/1993 |
| JP | H06-209203 | A | 7/1994 |
| JP | H07-30304 | A | 1/1995 |
| JP | 2000-516055 | A | 11/2000 |
| JP | 2005-184734 | A | 7/2005 |
| JP | 2009-171737 | A | 7/2009 |
| WO | WO9749140 | | 12/1997 |
| WO | WO-03056657 | A1 | 7/2003 |
| WO | WO-2004045018 | A1 | 5/2004 |
| WO | WO-2004084340 | A1 | 9/2004 |
| WO | WO2007149046 | A1 | 12/2007 |
| WO | WO2010032023 | A1 | 3/2010 |
| WO | WO-2010040119 | A1 | 4/2010 |
| WO | WO-2013158991 | A1 | 10/2013 |
| WO | WO-2013158994 | A1 | 10/2013 |
| WO | WO-2013158995 | A1 | 10/2013 |
| WO | WO-2013159010 | A1 | 10/2013 |

OTHER PUBLICATIONS

Zhao et al. (2010) "RF evanescent-mode cavity resonator for passive wireless sensor applications" *Sensors and Actuators A: Physical* 161: 322-328.

Arif, M.S., et al., "A high-Q magnetostatically-tunable all-silicon evanescent cavity resonator", Microwave Symposium Digest (MTT), 2011 IEEE MTT-S International, IEEE, Jun. 5, 2011, pp. 1-4, XP032006913, DOI: 10.1109/MWSYM.2011.5972966 ISBN: 978-1-61284-754-2 p. 1, left-hand column, line 32—right-hand column, line 5; figure 1 p. 2, right-hand column, line 5-line9; figure 2.

Liu X., et al., "Capacitive monitoring of electrostatic MEMS tunable evanescent-mode cavity resonators", Microwave Integrated Circuits Conference (EUMIC), 2011 European, IEEE, Oct. 10, 2011, pp. 466-469, XP032073230, ISBN: 978-1-61284-236-3.

Park S.J., et al., "High-Q RF-MEMS 4-6-GHz Tunable Evanescent-Mode Cavity Filter", IEEE Transactions on Microwave Theory and Techniques IEEE Service Center Piscataway NJ US, vol. 58, No. 2, Feb. 1, 2010 pp. 381-389, XP011300554, ISSN: 0018-9480.

International Search Report and Written Opinion—PCT/US2013/037368—ISA/EPO—Jul. 18, 2013.

Written Opinion—PCT/US2013/037368—ISA/EPO—Mar. 25, 2014.

International Search Report and Written Opinion—PCT/US2013/037364—ISA/EPO—Jul. 17, 2013.

Written Opinion—PCT/US2013/037364—ISA/EPO—Mar. 25, 2013.

International Search Report and Written Opinion—PCT/US2013/037370—ISA/EPO—Jul. 15, 2013.

Written Opinion—PCT/US2013/037370—ISA/EPO—Apr. 1, 2014.

International Search Report and Written Opinion—PCT/US2013/037396—ISA/EPO—Jul. 12, 2013.

Written Opinion—PCT/US2013/037396—ISA/EPO—Apr. 1, 2014.

U.S. Office Action dated Jul. 18, 2014, issued in U.S. Appl. No. 13/451,392.

U.S. Notice of Allowance dated Jul. 22, 2014, issued in U.S. Appl. No. 13/451,397.

International Preliminary Report on Patentability—PCT/US2013/037368—ISA/EPO—Jul. 18, 2014.

International Preliminary Report on Patentability—PCT/US2013/037364—ISA/EPO—Jul. 18, 2014.

International Preliminary Report on Patentability—PCT/US2013/037370—ISA/EPO—Jul. 18, 2014.

International Preliminary Report on Patentability—PCT/US2013/037396—ISA/EPO—Jul. 18, 2014.

Chinese Office Action Dated Jun. 24, 2015 Issued in 201380027638.8.

Japanese Office Action Dated Mar. 30, 2015 Issued in 2015-507220.

* cited by examiner

ISOTROPICALLY-ETCHED CAVITIES FOR EVANESCENT-MODE ELECTROMAGNETIC-WAVE CAVITY RESONATORS

TECHNICAL FIELD

This disclosure relates generally to electromechanical systems (EMS), and more specifically to isotropically-etched cavities for use in evanescent-mode electromagnetic-wave cavity resonators.

DESCRIPTION OF THE RELATED TECHNOLOGY

Electromechanical systems (EMS) include devices having electrical and mechanical elements, transducers such as actuators and sensors, optical components (including mirrors), and electronics. EMS can be manufactured at a variety of scales including, but not limited to, microscales and nanoscales. For example, microelectromechanical systems (MEMS) devices can include structures having sizes ranging from about one micron to hundreds of microns or more. Nanoelectromechanical systems (NEMS) devices can include structures having sizes smaller than one micron including, for example, sizes smaller than several hundred nanometers. Electromechanical elements may be created using deposition, etching, lithography, or other micromachining processes that etch away parts of substrates or deposited material layers, or that add layers to form electrical, mechanical, and electromechanical devices.

One type of EMS device is called an interferometric modulator (IMOD). As used herein, the term IMOD or interferometric light modulator refers to a device that selectively absorbs or reflects light using the principles of optical interference. In some implementations, an IMOD may include a pair of conductive plates, one or both of which may be transparent or reflective, wholly or in part, and capable of relative motion upon application of an appropriate electrical signal. In an implementation, one plate may include a stationary layer deposited on a substrate and the other plate may include a reflective membrane separated from the stationary layer by an air gap. The position of one plate in relation to another can change the optical interference of light incident on the IMOD. IMOD devices have a wide range of applications, and are anticipated to be used in improving existing products and creating new products, especially those with display capabilities.

Various electronic circuit components can be implemented at the EMS level, including resonators. Tunable resonators operating between 0.5 and 4 GHz with quality (Q) factors of greater than 100 may be of interest for synthesizing multi-frequency or reconfigurable filters such as for use in mobile handsets or other portable consumer electronics devices. Prior tunable component development work has resulted in devices with cost structures and form factors that are prohibitive for consumer electronics applications due to inherent inefficiencies in their individual, device-level fabrication, assembly, and calibration processes.

For example, evanescent-mode cavity resonators have been fabricated using low-temperature, co-fired ceramic (LTCC) layered composite radio frequency (RF) substrate materials, or, more recently, by stereo-lithographically-patterned polymers or bulk-micromachining single-crystal silicon. LTCC-based manufacturing can be expensive and can require thermal processing that can induce shrinkage of ceramic parts, complicating the maintaining of tight dimensional tolerances.

SUMMARY

The structures, devices, apparatus, systems, and processes of the disclosure each have several innovative aspects, no single one of which is solely responsible for the desirable attributes disclosed herein.

Disclosed are example implementations of EMS resonators, devices, apparatus, systems, and related fabrication processes. According to one innovative aspect of the subject matter described in this disclosure, a device includes an evanescent-mode electromagnetic-wave cavity resonator. In some implementations, the resonator includes an isotropically-etched cavity operable to support one or more evanescent electromagnetic wave modes, the isotropically-etched cavity including an inner cavity surface and a mating surface around a periphery of the cavity, the inner cavity surface having a conductive layer deposited or patterned over it. In some implementations, the resonator also includes a cavity ceiling arranged to form a volume in conjunction with the isotropically-etched cavity, the cavity ceiling including a cavity ceiling surface having a conductive layer deposited or patterned over it. In some implementations, the resonator also includes a capacitive tuning structure having a portion that is located at least partially within the volume so as to support the one or more evanescent electromagnetic wave modes, the tuning structure being formed from a conductive material or having a conductive layer deposited or patterned over it, a distal surface of the tuning structure being separated from the closest surface to it by a gap distance, a resonant electromagnetic wave mode of the cavity resonator being dependent at least partially on the gap distance.

In some implementations, the isotropically-etched cavity is substantially hemispheric. In some implementations, the tuning structure includes a post. In some implementations, the post is a vertically-extending post that extends distally from a central region of the inner cavity surface of the cavity. In some other implementations, the post is an in-plane post extending radially or transversely across the isotropically-etched cavity. In some implementations, the resonator also includes a post top concentric with the post and having a radius or width larger than a corresponding radius or width of the post.

In some implementations, the gap distance is adjustable to dynamically change a resonant frequency or mode of the cavity resonator. In some implementations, the resonator also includes one or more tuning elements arranged within the gap distance and actuatable to adjust the magnitude of the gap distance to effect the change in the resonant mode of the resonator. In some implementations, each tuning element includes one or more MEMS. In some implementations, the resonator also includes one or more dielectric spacers arranged within the gap distance, the one or more dielectric spacers defining a static magnitude of the gap distance between a distal surface of the tuning structure and the cavity ceiling.

According to another innovative aspect of the subject matter described in this disclosure, a device includes an evanescent-mode electromagnetic-wave cavity resonating means. In some implementations, the resonating means include an isotropically-etched cavity means operable to support one or more evanescent electromagnetic wave modes, the isotropically-etched cavity means including an inner cavity surface and a mating means around a periphery of the cavity, the inner cavity surface having a conductive means deposited or patterned over it. In some implementations, the resonating means also includes a cavity ceiling means arranged to form a volume in conjunction with the isotropically-etched cavity means, the cavity ceiling means including a cavity ceiling surface having a conductive means deposited or patterned over it. In some implementations, the resonating means also includes a capacitive tuning means having a portion that is located at least partially within the volume so as to support the one or more evanescent electromagnetic wave modes, the tuning means being formed from a conductive material or having a conductive means deposited or patterned over it, a distal surface of the tuning means being separated from the closest surface to it by a gap distance, a resonant electromagnetic wave mode of the cavity resonating means being dependent at least partially on the gap distance.

In some implementations, the isotropically-etched cavity means is substantially hemispheric. In some implementations, the tuning means includes a post. In some implementations, the post is a vertically-extending post that extends distally from a central region of the inner cavity surface of the cavity means. In some other implementations, the post is an in-plane post extending radially or transversely across the isotropically-etched cavity means. In some implementations, the resonating means also includes a top means concentric with the post and having a radius or width larger than a corresponding radius or width of the post.

In some implementations, the gap distance is adjustable to dynamically change a resonant frequency or mode of the cavity resonating means. In some implementations, the resonating means also includes one or more tuning elements arranged within the gap distance and actuatable to adjust the magnitude of the gap distance to effect the change in the resonant mode of the resonating means. In some implementations, each tuning element includes one or more MEMS. In some implementations, the resonating means also includes one or more dielectric spacer means arranged within the gap distance, the one or more dielectric spacer means defining a static magnitude of the gap distance between a distal surface of the tuning means and the cavity ceiling means.

According to another innovative aspect of the subject matter described in this disclosure, a method includes producing a cavity substrate; positioning the cavity substrate over an etch-stop substrate; connecting a lower surface of the cavity substrate with an upper surface of the etch-stop substrate; and isotropically etching the cavity substrate to produce a plurality of cavities, each cavity being suitable for use in an evanescent-mode electromagnetic wave cavity resonator.

In some implementations, isotropically etching the cavity substrate to produce a plurality of cavities includes continuing to isotropically etch the cavity substrate after the etching has exposed the etch-stop substrate until a desired region of the etch-stop substrate is exposed within each corresponding cavity. In some implementations, the lower surface of each cavity is planar and defined by the upper surface of the etch-stop substrate within the respective cavity, and the side surface of each cavity is curved as a result of the isotropic etching. In some implementations, isotropically etching the cavity substrate to produce a plurality of cavities includes continuing to isotropically etch the cavity substrate after the etching has exposed the etch-stop substrate until a desired region of the etch-stop substrate is exposed within each corresponding cavity while leaving a portion of the material within each cavity so as to form a capacitive tuning structure within each cavity. In some such implementations, one or more of the cavities each have a truncated substantially hemispheric shape.

Details of one or more implementations of the subject matter described in this specification are set forth in the accompanying drawings and the description below. Although the examples provided in this disclosure may be described in terms of EMS and MEMS-based displays, the concepts provided herein may apply to other types of displays, such as liquid crystal displays (LCDs), organic light-emitting diode (OLEDs) displays and field emission displays. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
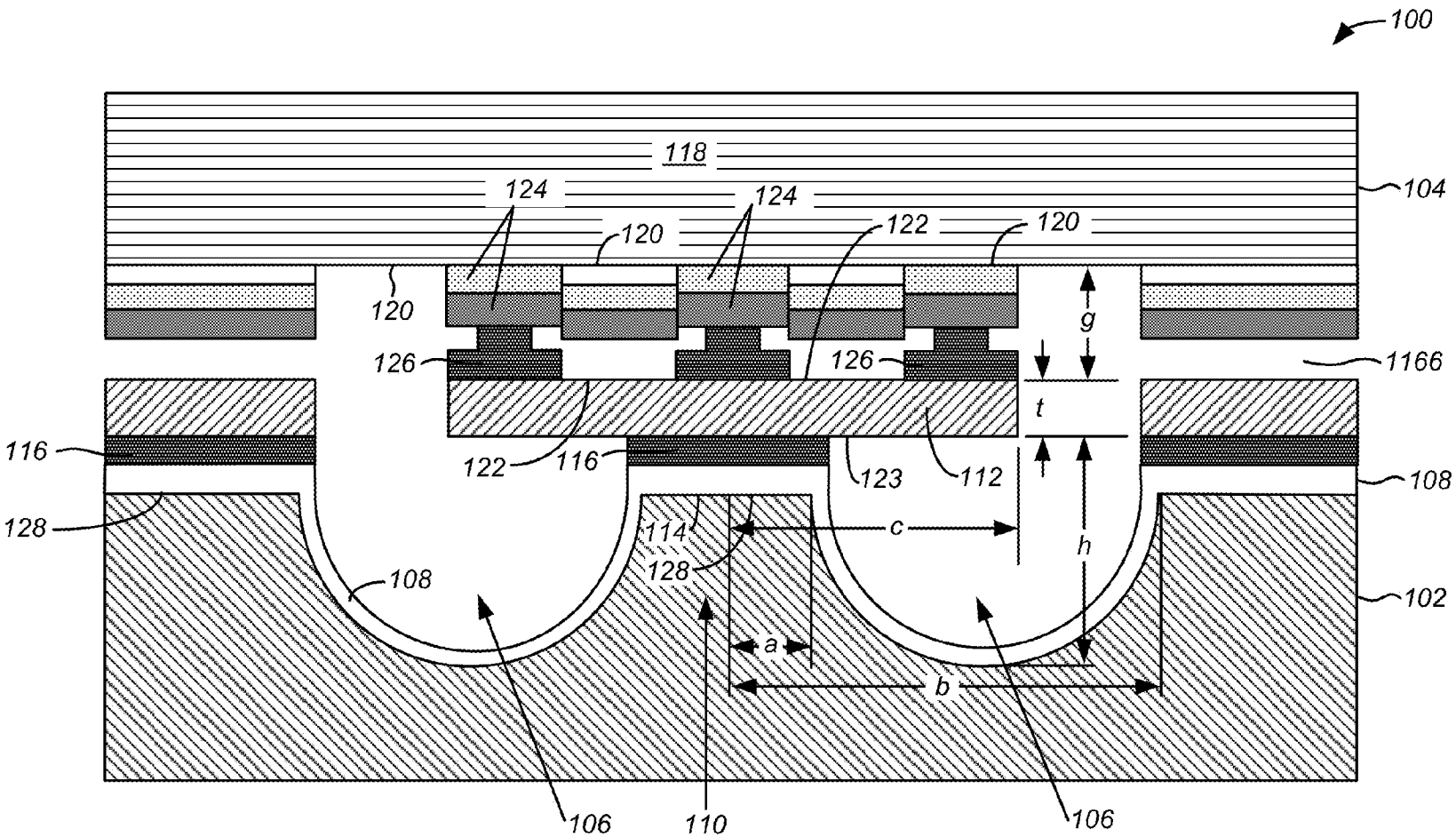
FIG. 1A shows a cross-sectional side view depiction of an example evanescent-mode electromagnetic-wave cavity resonator.

The following detailed description is directed to certain implementations for the purposes of describing the innovative aspects. However, the teachings herein can be applied and implemented in a multitude of different ways.

The disclosed implementations include examples of structures and configurations of EMS and MEMS resonator devices, including evanescent-mode electromagnetic-wave cavity resonators (hereinafter "evanescent-mode cavity resonators" or simply "cavity resonators)). Related apparatus, systems, and fabrication processes and techniques are also disclosed.

Some example implementations include two- or three-substrate fabrication and assembly processes. For example, various process implementations can be performed at a substrate-, wafer-, panel-, or batch-level. Performing processing at these levels can reduce cost while increasing efficiency and uniformity. Some implementations also utilize standard, low-cost batch process techniques, such as bulk wet-etching. Some process implementations can yield batches of cavity resonators with the requisite cost structure and dimensional tolerances required or desired for a multitude of applications. For example, such processes can produce tunable cavity resonators having operating ranges between approximately 0.5 and approximately 4 GHz with quality (Q) factors of greater than 100. Some implementations produce cavity resonators that can be used to synthesize multi-frequency or reconfigurable filters, such as for use in mobile handsets or other portable consumer electronics devices.

Some example implementations include isotropically-etched cavities for use in evanescent-mode electromagnetic-wave cavity resonators. In some implementations, the isotropic etching operation produces a plurality of cavities. In some implementations, the isotropic etching operation results in an array of cavities each suitable for use in an evanescent-mode electromagnetic-wave cavity resonator. In some implementations, the array of cavities can have a multitude of possible shapes. In some implementations, the cavities within a given array can have varied shapes and sizes. For example, in some implementations an isotropic wet-etching operation is performed on a substrate having an etch-stop on a side of the substrate resulting in a plurality of cavities having planar bottom surfaces and curved side surfaces.

Some example implementations include topped-post structures (hereinafter also "top-post structures," "top-posts," or "post tops") for use in evanescent-mode electromagnetic-wave cavity resonators. That is, in some example implementations, a cavity resonator is produced that includes a capacitive tuning structure or post within the cavity volume that itself includes a post top positioned on, arranged on, or otherwise connected with or integrally formed adjacent to the post's distal surface.

Some example implementations include dielectric spacers arranged in a gap between the distal surface of the post top (or post) of an evanescent-mode electromagnetic-wave cavity resonator and the cavity ceiling surface of the resonator. In some implementations, a gap distance is statically-defined by a thickness of the dielectric spacers.

Some example implementations include one or more tuning elements arranged in a gap between the distal surface of the post top (or post) of an evanescent-mode electromagnetic-wave cavity resonator and the cavity ceiling surface of the resonator. In some implementations, each tuning element includes at least one electrostatically- or piezoelectrically-actuatable MEMS. In some implementations, an actual magnitude of the gap distance is statically defined by the thickness of dielectric spacers and dynamically or adjustably dependent on an actuation state of the tuning elements. Because the capacitance between the post top (or post) and the cavity ceiling is dependent on the actual magnitude of the gap distance, one or more resonant electromagnetic-wave modes are dependent or tunable by way of actuating the tuning elements.

Some example implementations include lithographically-patterned in-plane resonator structures for use in evanescent-mode electromagnetic-wave cavity resonators. For example, in some implementations lithographic processes are used to produce in-plane resonator structures having a gap whose base or steady-state dimension is lithographically-defined concurrently with the remaining portions of the resonator structure. In contrast, traditional processes produce cavity resonators in which the gap is assembly-defined; that is, defined by the distance between two distinct conductive portions that are fabricated separately and subsequently arranged in proximity to one another.

FIG. 1A shows a cross-sectional side view depiction of an example evanescent-mode electromagnetic-wave cavity resonator 100. The cavity resonator 100 includes a lower cavity portion 102 and an upper cavity portion 104. The lower cavity portion 102 includes a cavity 106. In some implementations, the cavity 106 is formed from the lower cavity portion 102 through an etching operation. In particular implementations, the cavity 106 is formed through an isotropic wet-etching operation resulting in curved cavity walls. In some other implementations, the cavity 106 is formed through an anisotropic etching operation resulting in substantially straight or vertical cavity walls. In some implementations, the cavity 106 is evacuated of air or filled with other gas.

In some implementations, the bulk substrate portions of the lower cavity portion 102 or the upper cavity portion substrate 104 can be formed of an insulating or dielectric material. For example, in some implementations, the bulk substrate portions of the lower cavity portion 102 or the upper cavity portion substrate 104 can be made of display-grade glass (such as alkaline earth boro-aluminosilicate) or soda lime glass. Other suitable insulating materials include silicate glasses, such as alkaline earth aluminosilicate, borosilicate, or modified borosilicate. Also, ceramic materials such as aluminum oxide (AlOx), yttrium oxide ($Y_2O_3$), boron nitride (BN), silicon carbide (SiC), aluminum nitride (AlN), and gallium nitride (GaNx) also can be used in some implementations. In some other implementations, high-resistivity Si can be used. In some implementations, silicon on insulator (SOI) substrates, gallium arsenide (GaAs) substrates, indium phosphide (InP) substrates, and plastic (polyethylene naphthalate or polyethylene terephthalate) substrates, e.g., associated with flexible electronics, also can be used.

In some implementations, the cavity 106 is plated with one or more conductive layers 108. For example, the conductive layer 108 can be formed by plating the surface of the lower cavity portion 102 with a conductive metal or metallic alloy. For example, the conductive layer 108 can be formed from nickel (Ni), aluminum (Al), copper (Cu), titanium (Ti), aluminum nitride (AlN), titanium nitride (TiN), aluminum copper (AlCu), molybdenum (Mo), aluminum silicon (AlSi), platinum (Pt), tungsten (W), ruthenium (Ru), or other appropriate or suitable materials or combinations thereof. In some implementations, a thickness in the range of approximately 1 μm to approximately 20 μm can be suitable. However, thinner or thicker thicknesses may be appropriate or suitable in other implementations or applications.

The cavity resonator 100 also includes a capacitive tuning structure or "post" 110. In some implementations, the post 110 is integrally formed from the lower cavity portion 102 during the etching operation that defined the corresponding cavity 106. The post 110 can have curved or straight vertical post walls. For example, the walls of the post 110 can be curved when an isotropic etching operation is used to form the cavity 106. The post 110 also can be plated with the conductive layer 108. In some implementations, the post 110 can have a circular cross-sectional shape. In some other implementations, the post 110 can have an elliptical, square, rectangular, or other cross-sectional shape. In some implementations, a dimension of the cross-sectional shape of the post 110, such as the diameter or width, or the shape of the cross-sectional shape itself, varies along the length of the post 110. For example, an isotropic wet-etching operation can result in a post 110 having a circular cross-sectional shape whose diameter decreases distally along the length of the post 110. In various implementations, the post 110 can have a thickness or height in the range of approximately 100 μm to approximately 1000 μm, and a width or diameter in the range of approximately 0.1 mm to approximately 1 mm.

In some implementations, a post top 112 is arranged over the post 110. In some implementations, the post top 112 is disposed on the distal surface 114 of the post 110 and secured using a process such as soldering. For example, prior to arranging the post top 112 over the post 110, the distal surface 114 of the post 110 and other mating surfaces or regions of the lower cavity portion 102 can be plated with solder 116. In some implementations, the post top 112 is formed from a conductive material. In some other implementations, the post top 112 can be made of a dielectric or other suitable material and then be plated with a conductive layer, such as the conductive layer 108. For example, the post top 112 can be formed from Cu or be plated with a Cu layer having a thickness of approximately 10 μm. In various implementations, the post top 112 can be plated with a conductive layer formed from Cu having a thickness in the range of approximately 2 μm to approximately 20 μm. In some implementations, the post top 112 can have a circular cross-sectional shape. In some other implementations, the post top 112 can have an elliptical, square, rectangular, or other cross-sectional shape. In some implementations, the post top 112 can have the same cross-sectional shape (but generally different size) as the post 110. In some other implementations, the post top 112 can have a different cross-sectional shape than the post 110.

In particular implementations, the post top 112 has a thinner thickness but a wider dimension than the post 110. For example, in some applications, the post 110 can have a height h of approximately 1 mm and a diameter at the distal end of the post 110 of approximately 0.5 mm. In such applications, or others, the post top 112 can have a thickness or height t of approximately 10 μm and a diameter of approximately 2 mm. That is, in some implementations, the diameter or width of the post top 112 is significantly larger than the diameter or width of the underlying post 110. In some other implementations, the post top 112 can have a thickness in the range of approximately 2 lam and to approximately 100 μm, and a width or diameter in the range of approximately 0.2 mm to approximately 5 mm. Advantages of the increased surface area afforded by the post top 112 are described below.

In some implementations, the upper cavity portion 104 includes an assembly platform that functions as the post top 112 when joined with the post 110 below. In some implementations, an inner surface of the upper cavity portion 104 forms a cavity ceiling 120. One or more evanescent electromagnetic-wave modes, and corresponding resonant frequencies, of the cavity resonator 100 are dependent on the gap spacing g between the distal surface 122 of the post top 112 and the cavity ceiling 120, which in turn may depend on the state of one or more tuning elements or devices 124.

In particular implementations, one or more tuning elements or devices 124 are formed or arranged between the distal surface 122 of the post top 112 and the cavity ceiling 120. In the illustrated implementation, an array of tuning elements 124 is connected both to the post top 112 and to the cavity ceiling 120. In some other implementations, the tuning elements 124 may be connected only with the post top 112 (or to the post 110 when a post top 112 is not included) but not to the cavity ceiling 120. In some other implementations, the tuning elements 124 may be connected only with the cavity ceiling 120 but not to the post 110 or post top 112.

In some implementations, the tuning elements 124 can be arranged as one or more arrays of one or more tuning elements 124. In some implementations, each tuning element is or functions as a bi-state device, varactor, or bit that is individually or otherwise electrostatically- or piezoelectrically-actuatable. In some other implementations, each array of tuning elements is or functions as a bi-state device, varactor, or bit that is electrostatically- or piezoelectrically-actuatable at an array level. In some implementations, each tuning element 124 includes one or more MEMS that are individually or otherwise electrostatically- or piezoelectrically-actuatable. In some other implementations, the tuning elements 124 also can be implemented as analog devices, such as analog varactors. By selectively actuating ones of the tuning elements 124 to one or more activated states, the tuning elements 124 can be used to selectively change the actual or effective magnitude of the gap distance or spacing, g, in order to selectively effectuate a change in the capacitance between the post top 112 and the cavity ceiling surface 120. By changing this capacitance, the tuning elements 124 can be used to change one or more evanescent electromagnetic wave modes of the cavity resonator and thus tune the resonant frequency of the cavity resonator 100.

In some implementations, first ones of the MEMS elements 122 are connected to "standoffs" or "spacers" 126. For example, the spacers 126 can be formed from a dielectric material such as a silicon oxide or nitride. In some implementations, the combined thickness of the spacers 126 and the overlying tuning elements 124 define a static un-actuated magnitude of the gap spacing g. In some implementations, by actuating selected ones of the tuning elements 124, the gap spacing g can be increased, thereby decreasing the effective capacitance. In some implementations, by actuating selected ones of the tuning elements 124, the gap spacing g can be decreased, thereby increasing the effective capacitance. In some other implementations, increasing an effective gap spacing g is accomplished by means of decreasing the capacitance in the gap spacing, while decreasing an effective gap spacing g is accomplished by means of increasing the capacitance in the gap spacing. In some such implementations, the actual absolute length or distance of the gap spacing g can remain static or constant. In yet other implementations, the tuning elements 124 can be used to both increase or decrease the actual gap spacing g as well as to further modify the capacitance within the gap spacing (e.g., beyond the modification to the capacitance simply caused by the change in spacing).

Figure 1B:
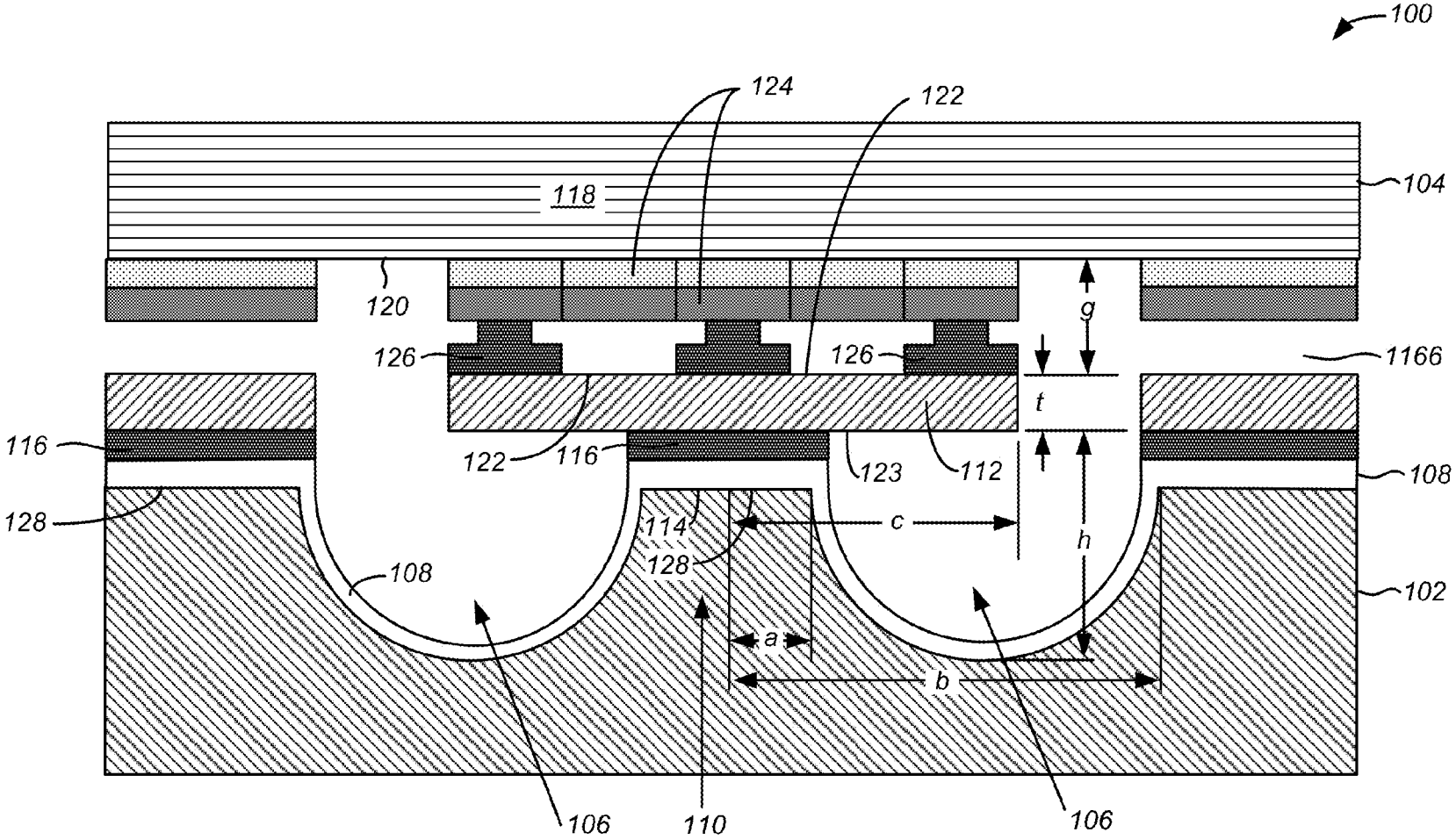
FIG. 1B shows a cross-sectional side view depiction of the example evanescent-mode electromagnetic-wave cavity resonator of FIG. 1A in an actuated state.

FIG. 1B shows a cross-sectional side view depiction of the example evanescent-mode electromagnetic-wave cavity resonator of FIG. 1A in an actuated state. In some implementations in which the MEMS elements 122 are piezoelectrically-actuated, an electric field is applied across a thickness of a tuning element 124. In some implementations in which the tuning elements 124 are electrostatically-actuated, an electric field is applied across a gap extending from a distal surface of the post 122 and a proximal surface of a tuning element 124.

In such implementations, the statically-defined or baseline magnitude of the gap spacing g is process-defined as opposed to assembly-defined. More specifically, the gap spacing g can be accurately and reproducibly defined by way of process techniques used during the formation of the upper cavity portion 104. For example, the gap spacing g can be defined at least in part by the selective patterning and subsequent removal of one or more sacrificial layers. This ensures uniformity and accuracy of the gap spacings in the resultant cavity resonators produced using some of the methods described below.

In still other implementations, the cavity resonator 100 does not include any tuning elements 124. In such implementations, the gap spacing g may be entirely dependent on the fixed or statically-defined thickness of the dielectric spacers 126. In some other implementations, the cavity resonator 100 does not include a post top 112. In some such implementations, the tuning elements 124 can be arranged on the distal surface of the post 110.

In some other implementations, the post top 112 can be integrally formed with the post 110 rather than being positioned or otherwise arranged on or over and connected with the post 110. For example, in some such implementations, the post 110 and the post top 112 can be integrally formed through a lithographically-defined etching operation. In some such implementations, some or all of the etching operation can be an isotropic wet-etching operation.

In some applications, advantages of implementations that include a post top 112 include a larger area for the tuning elements 124 arranged over the post top 112 as compared with the smaller area of the distal surface 114 of the underlying post 110. For example, in traditional designs, the ratio of the radius a of the post 110 to the radius b of the cavity 106 can be constrained by the requirement of a large cavity volume for a desired high Q factor. Moreover, in traditional designs, the necessary h/g ratio can be difficult to reliably achieve at low cost. But in some particular implementations having the post top design, the post radius a can be kept small for an improved Q factor while the radius c of the post top 112 can be made larger to increase the capacitive loading and hence achieve the desired range of resonant frequencies of the cavity resonator 100. This enables a reduction in cavity resonator size to the millimeter scale and below.

Additionally, using one or more batch processes as, for example, described below, such a post top design enables arrays of multiple cavity resonators 100 each having the same height h and radius b but having potentially different radii c of the corresponding post tops 112 within the respective cavity resonators 100. In some implementations, the resonant frequency of the cavity resonator 100 is generally inversely proportional to the radius c of the post top 112. In contrast, in conventional designs, the resonant frequency can be proportional to the radius of the post. In such a manner, frequency-determined loading can be set by lithographically-defined dimensions—the radii of the post tops 112 and the tuning elements 124—for each cavity resonator 100 of the array to produce an array of cavity resonators 100 as described below having potentially different resonant frequencies for a given post radius a, cavity radius b, and gap distance g.

Figure 2A:
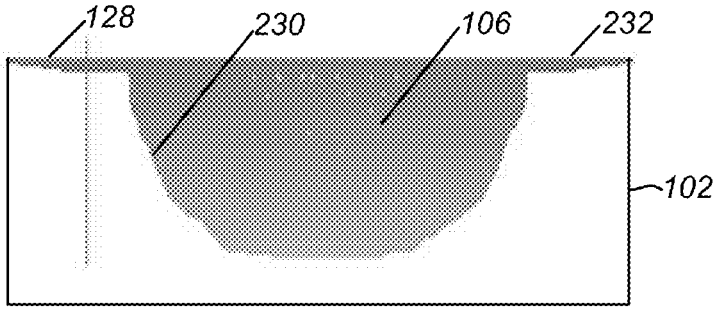
FIGS. 2A-2D show cross-sectional side views of simulations of example cavity shapes formed using one or more isotropic etching operations.

As described above, in some implementations the cavity 106 is formed using an isotropic wet-etching operation. For example, a mating surface 128 of the lower cavity portion 102 can be lithographically or otherwise masked followed by an isotropic wet-etching operation that produces a variety of shapes. FIGS. 2A-2D show cross-sectional side views of simulations of example cavity shapes formed using one or more isotropic etching operations. For example, FIG. 2A shows a cross-sectional side view of a cavity 106 having a substantially hemispheric shape; that is, having a circular cross-sectional shape when viewed from above. The cavity 106 shown in FIG. 2A includes an inner cavity surface 230. A periphery of the cavity 106 is surrounded by a mating surface 232.

Figure 2B:
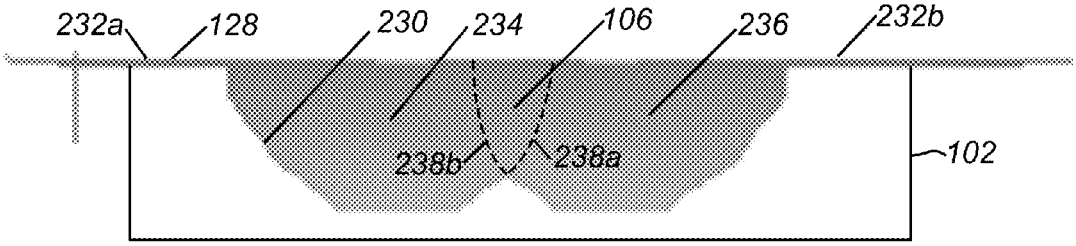

As another example, FIG. 2B shows a cross-sectional side view of a cavity 106 having a substantially "peanut" shape. For example, when viewed from above, the cavity 106 shown in FIG. 2B includes a first isotropically-etched cavity portion 234 and a second isotropically-etched cavity portion 236 having a mating surface 232*b* that is coplanar with a mating surface 232*a* of the first isotropically-etched cavity. In such implementations, a circumference of the first isotropically-etched cavity portion 234 can overlap a circumference of the second isotropically-etched cavity portion 236 as indicated by dotted lines 238*a* and 238*b*.

Figure 2C:
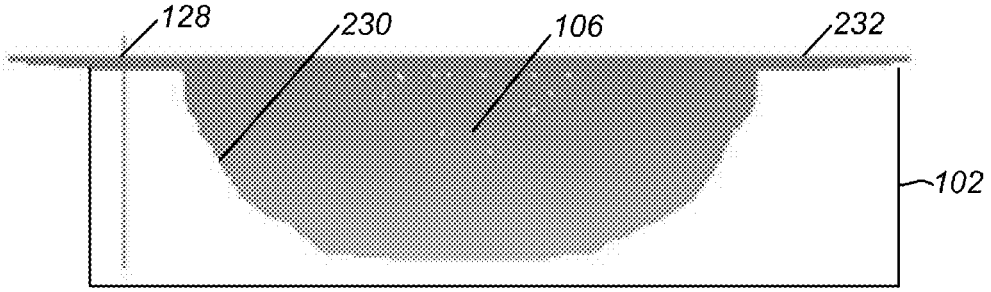
Figure 3A:
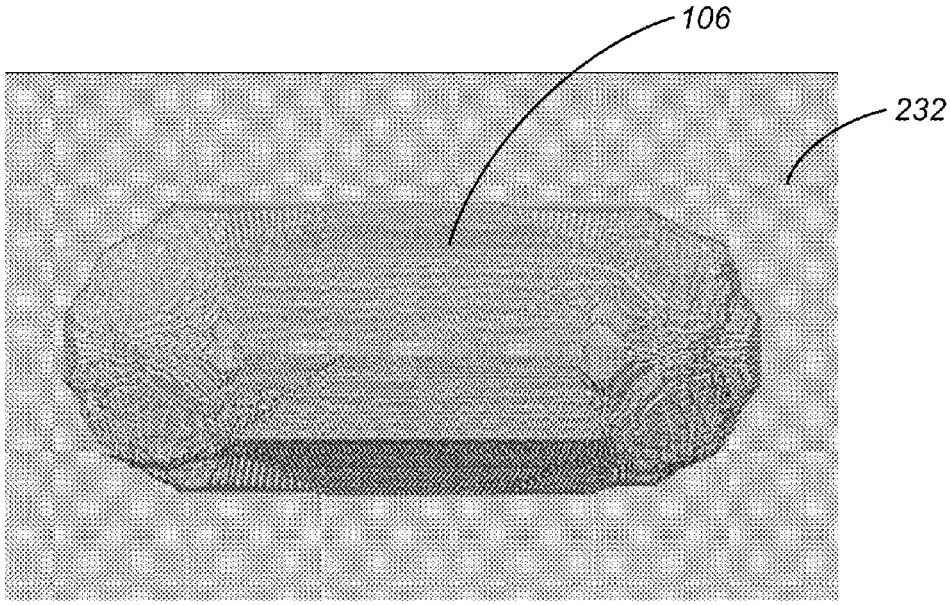
FIG. 3A shows an overhead view of an example cavity such as that shown in FIG. 2C.
Figure 3B:
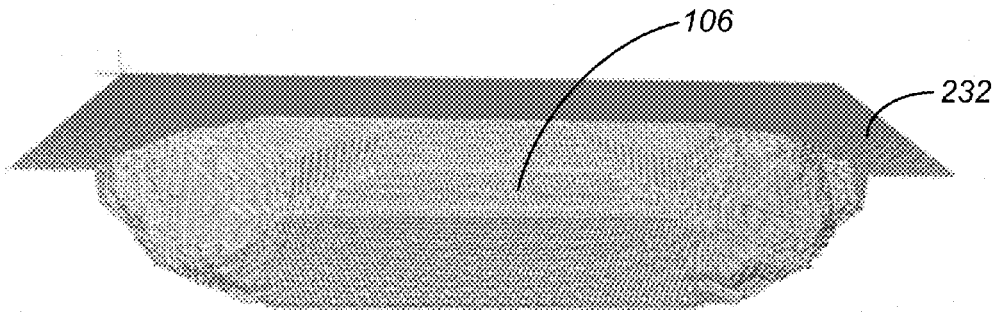
FIG. 3B shows a cross-sectional perspective view of the example cavity of FIG. 3A.

As another example, FIG. 2C shows a cross-sectional side view of a cavity 106 having a shape that is characteristically like a half of an ellipsoid. For example, the mating surface 232 of the isotropically-etched cavity 106 can be coplanar with a plane parallel to both the major axis and the minor axis of the half of the ellipsoid. FIG. 3A shows an overhead view of an example cavity 106 such as that shown in FIG. 2C. FIG. 3B shows a cross-sectional perspective view of the example cavity 106 of FIG. 3A.

Figure 2D:
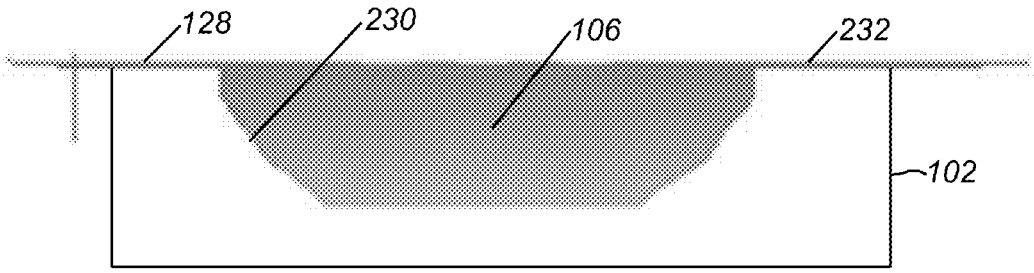
Figure 4A:
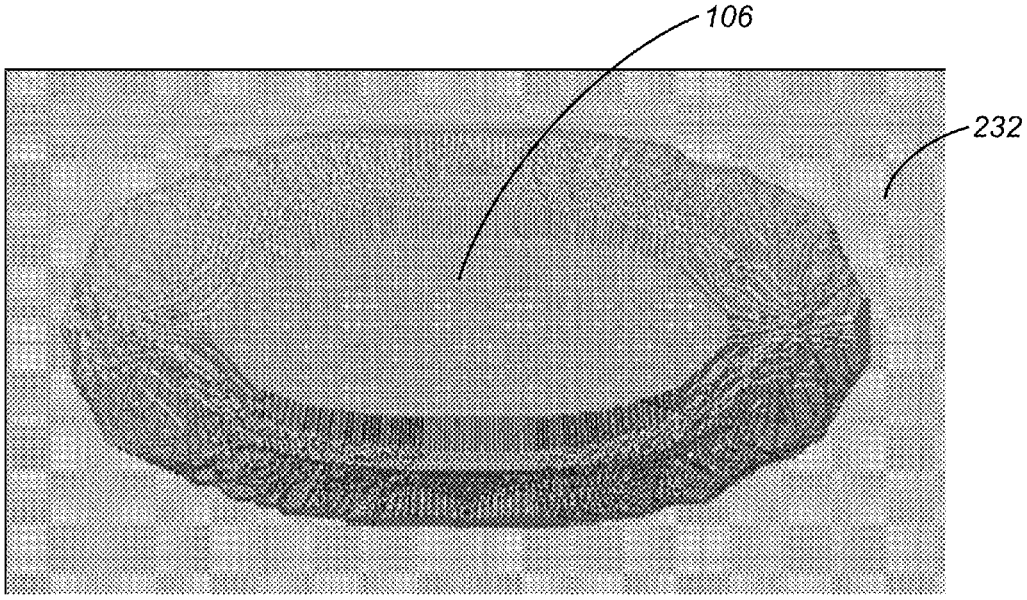
FIG. 4A shows an overhead view of an example cavity such as that shown in FIG. 2D.
Figure 4B:
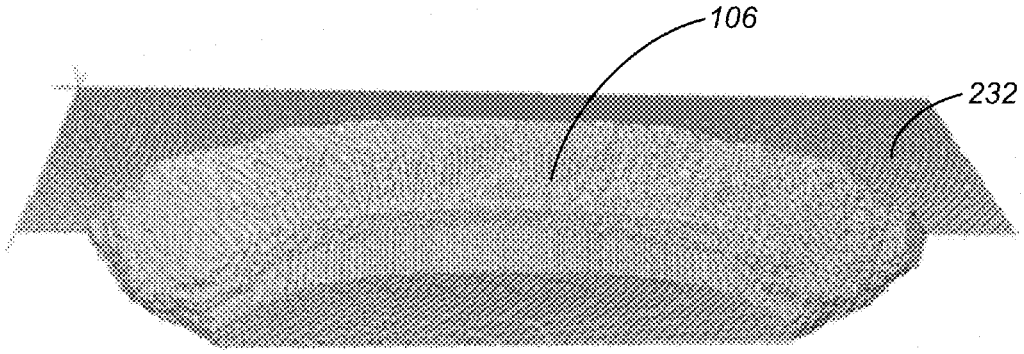
FIG. 4B shows a cross-sectional perspective view of the example cavity of FIG. 4A.

As another example, FIG. 2D shows a cross-sectional side view of a cavity 106 having a substantially "bath tub" shape. For example, when viewed from above, the cavity 106 shown in FIG. 2D can be of a shape that is characteristically circular, as in FIG. 2A, or ellipsoidal, as in FIG. 2C, for example. However, in such implementations, the cavity 106 of FIG. 2D can have a first approximately planar inner bottom surface 240 parallel to but recessed from the mating surface 232 of the isotropically-etched cavity 106 and a second curved inner cavity side surface 244 that connects the mating surface 232 of the isotropically-etched cavity 106 with the first planar inner bottom surface 240. For example, such a cavity 106 as shown in FIG. 2D can be formed by isotropically etching a substrate having an etch stop material layer on a side of the substrate. FIG. 4A shows an overhead view of an example cavity 106 such as that shown in FIG. 2D. FIG. 4B shows a cross-sectional perspective view of the example cavity 106 of FIG. 4A.

Figure 5A:
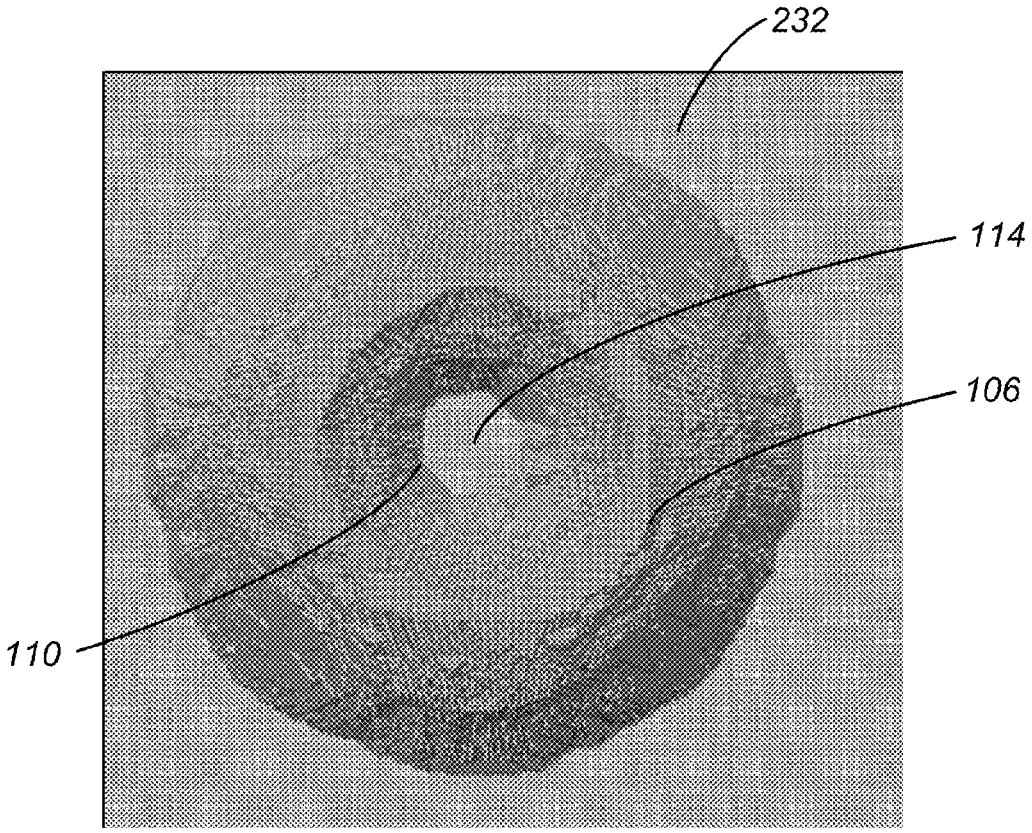
FIG. 5A shows an overhead view of an example cavity having a "donut-like" cross-sectional shape.
Figure 5B:
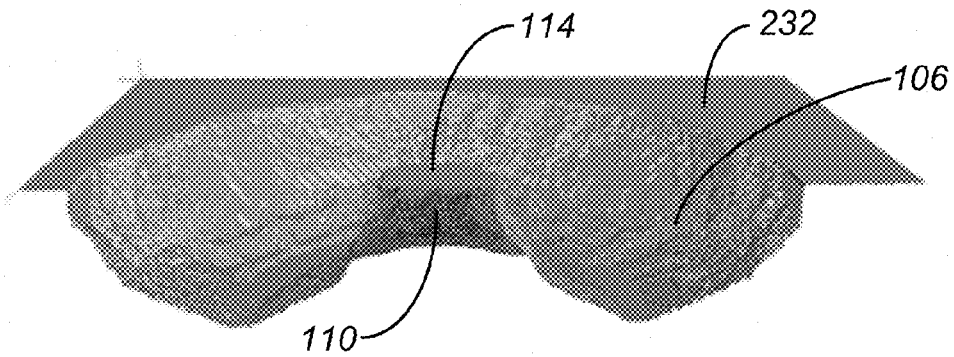
FIG. 5B shows a cross-sectional perspective view of the example cavity of FIG. 5A.

The proposed designs and other similar designs of isotropically-etched cavities 106 also can be used in conjunction with capacitive tuning structures or posts 110. In some implementations, a post 110 can be integrally formed in a central region of each cavity during the isotropic wet-etching operation. FIG. 5A shows an overhead view of an example cavity 106 having a "donut-like" cross-sectional shape. In this analogy, the "donut hole" is actually the post 110. FIG. 5B shows a cross-sectional perspective view of the example cavity 106 of FIG. 5A. For example, the cavity resonator 100 shown in FIG. 1 incorporates a similar cavity 106 and post 110 as shown in FIGS. 5A and 5B.

Figure 6:
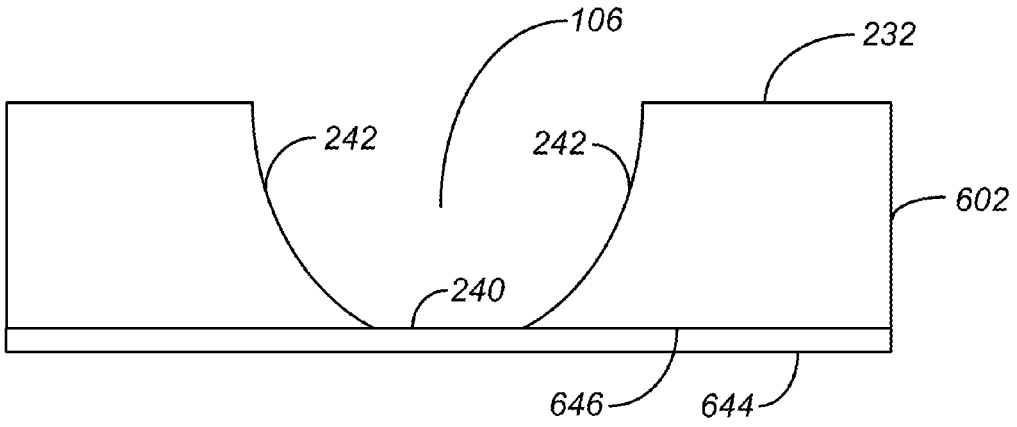
FIG. 6 shows an example cavity substrate that includes an etch-stop.

FIG. 6 shows an example cavity substrate 602 that includes an etch-stop 644. For example, the substrate 602 can include one or more lower cavity portions 102. In some implementations, the substrate 602 can be formed of an insulating or dielectric material. For example, the substrate 602 can be a low-cost, high-performance, large-area insulating substrate. In some implementations, the substrate 602 can be made of display-grade glass (such as alkaline earth boro-aluminosilicate) or soda lime glass. Other suitable insulating materials from which the substrate 602 can be formed include silicate glasses, such as alkaline earth aluminosilicate, borosilicate, or modified borosilicate. Also, ceramic materials such as AlO, $Y_2O_3$, BN, SiC, AlN, and GaN also can be used in some implementations. In some other implementations, the substrate 602 can be formed of high-resistivity Si. In some implementations, SOI substrates, GaAs substrates, InP substrates, and plastic (polyethylene naphthalate or polyethylene terephthalate) substrates, e.g., associated with flexible electronics, also can be used. The substrate 602 also can be in conventional Integrated Circuit (IC) wafer form, e.g., 4-inch, 6-inch, 8-inch, 12-inch, or in large-area panel form. For example, flat panel display substrates with dimensions such as 370 mm×470 mm, 920 mm×730 mm, and 2850 mm×3050 mm, or larger, can be used.

In some implementations, the bottom surface 646 of the substrate 602 can be plated with an etch-stop material to form the etch-stop 644 prior to the isotropic wet-etching operation. For example, the etch-stop 644 can be formed from, for example, Ni or Cu. In this way, during the isotropic etching operation, the etching may proceed isotropically but the portions of the etchant that reach the etch-stop during the etching operation can etch no further. This can result in a cavity 106 with a flat or planar bottom surface 240 and a curved side surface 242, as shown in FIG. 6. Additionally, the ratio of the volume of the cavity 106 to the height h of the cavity 106 can be significantly increased for a given thickness of the substrate 604 potentially resulting in, among other advantages or desired characteristics, an improved Q factor.

Figure 7:
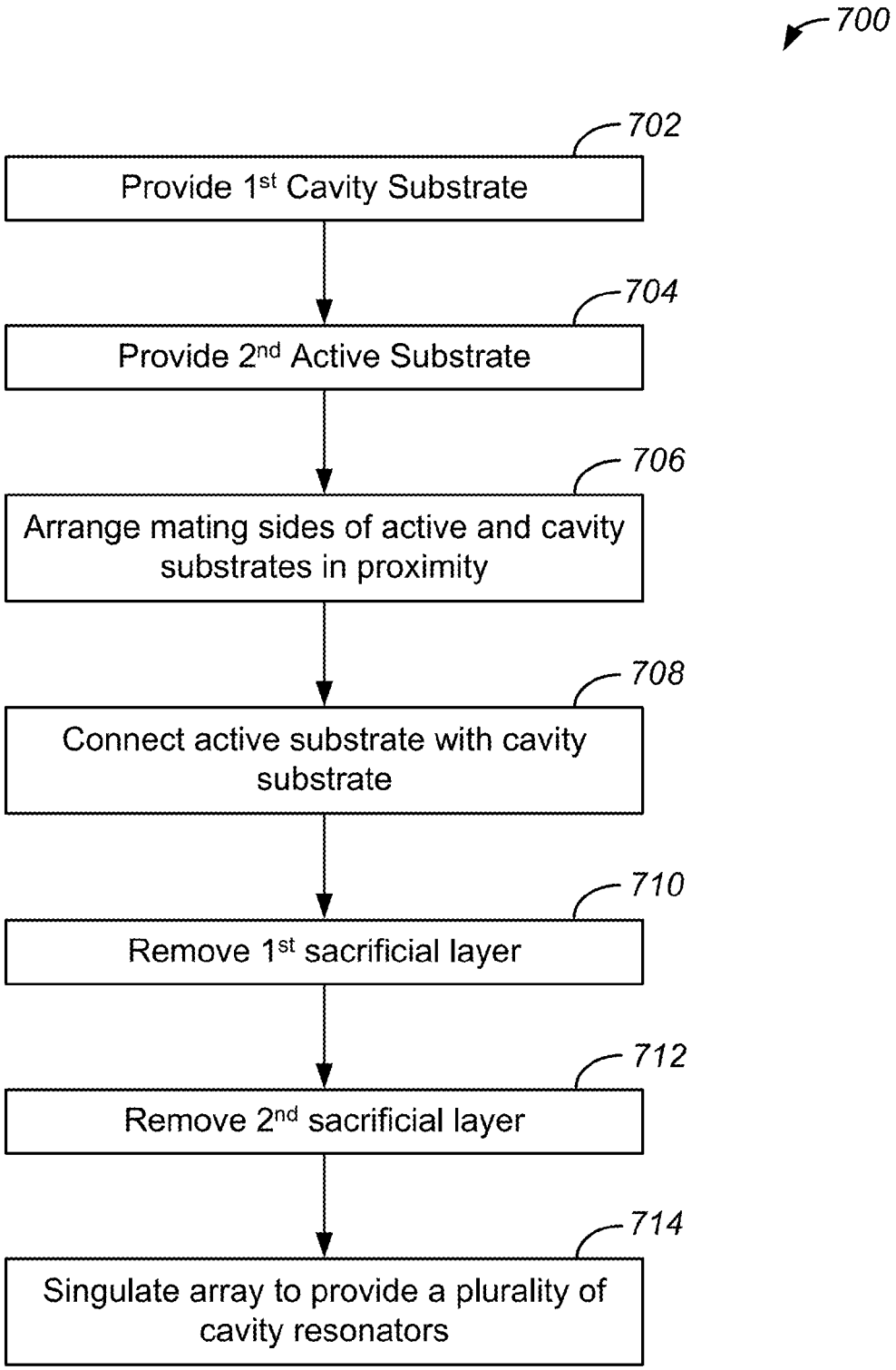
FIG. 7 shows a flow diagram depicting an example two-substrate process for forming a multiplicity of evanescent-mode electromagnetic-wave cavity resonators.

FIG. 7 shows a flow diagram depicting an example two-substrate process 700 for forming a multiplicity of evanescent-mode electromagnetic-wave cavity resonators. For example, process 700 can be used to produce a multiplicity of the cavity resonators 100 shown in FIGS. 1A and 1B. In some implementations, the two-substrate process 700 begins in block 702 with providing a first or "cavity" substrate 902. For example, the cavity substrate 902 can include a plurality of lower cavity portions 102 each suitable for use in a cavity resonator 100.

Figure 8:
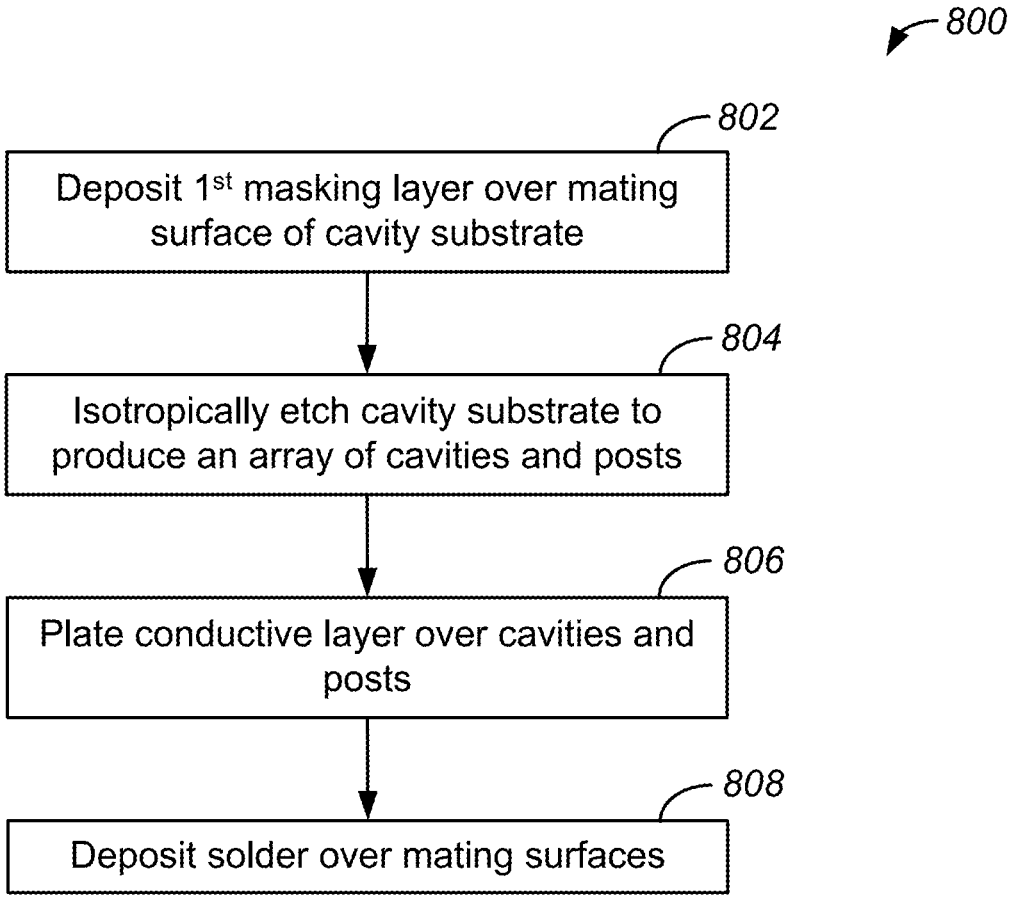
FIG. 8 shows a flow diagram depicting an example process for forming an example cavity substrate.
Figure 9A:
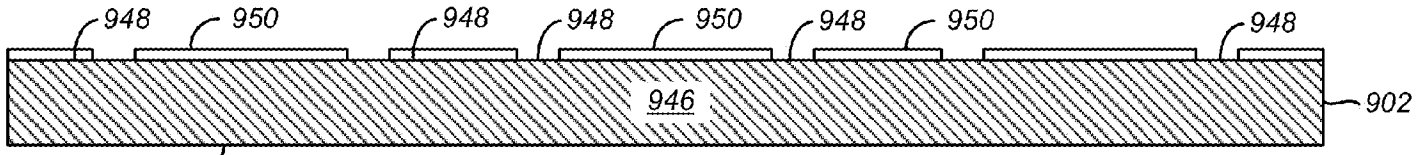
FIG. 9A shows a cross-sectional side view depiction of an example cavity substrate.

FIG. 8 shows a flow diagram depicting an example process 800 for forming an example cavity substrate 902. FIG. 9A shows a cross-sectional side view depiction of an example cavity substrate 902. The cavity substrate 902 includes a first bulk substrate portion 946 having a mating surface 948. In some implementations, the bulk substrate portion 946 can be formed of an insulating or dielectric material. For example, the bulk substrate portion 946 can be a low-cost, high-performance, large-area insulating substrate. In some implementations, the bulk substrate portion 946 can be made of display-grade glass (such as alkaline earth boro-aluminosilicate) or soda lime glass. Other suitable insulating materials from which the bulk substrate portion 946 can be formed include silicate glasses, such as alkaline earth aluminosilicate, borosilicate, or modified borosilicate. Also, ceramic materials such as AlO, $Y_2O_3$, BN, SiC, AlN, and GaN also can be used in some implementations. In some other implementations, the bulk substrate portion 946 can be formed of high-resistivity Si. In some implementations, SOI substrates, GaAs substrates, InP substrates, and plastic (polyethylene naphthalate or polyethylene terephthalate) substrates, e.g., associated with flexible electronics, also can be used. The bulk substrate portion 946 also can be in conventional IC wafer form, e.g., 4-inch, 6-inch, 8-inch, 12-inch, or in large-area panel form. For example, flat panel display substrates with dimensions such as 370 mm×470 mm, 920 mm×730 mm, and 2850 mm×3050 mm, or larger, can be used.

Figure 9B:
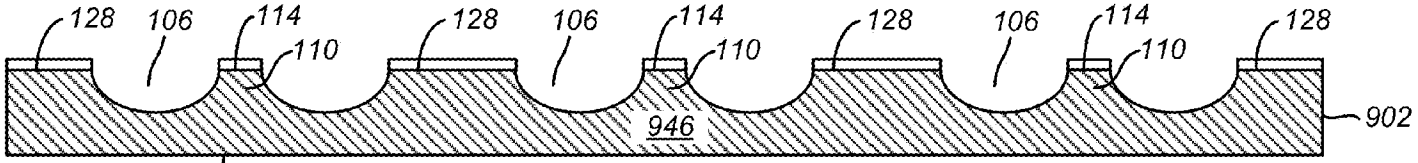
FIG. 9B shows a cross-sectional side view depiction of the example cavity substrate of FIG. 9A after an isotropic etching operation.

In some implementations, the process 800 begins in block 802 with depositing a first masking layer 950 over the mating surface 948 of the cavity substrate 902 as depicted in FIG. 9A. In some implementations, the masking layer 950 is a positive or negative photolithographic photoresist. In some other implementations, the masking layer 950 can be formed from a metal or dielectric thin film that is not etched by the same etchant that is used to etch the cavity substrate 902. In some implementations, the process 800 proceeds in block 804 with isotropically etching the unmasked portions of the bulk substrate portion 946. In some implementations, the isotropic etching operation in block 804 can be an isotropic wet etching operation. For example, FIG. 9B shows a cross-sectional side view depiction of the example cavity substrate 902 of FIG. 9A after an isotropic etching operation. As shown in FIG. 9B, after the isotropic etching operation, the cavity substrate 902 can include a plurality of cavities 106 as well as integrally-formed posts 110. Additionally, as shown in FIG. 9B, the isotropic etching results inherently in etching portions of the bulk substrate 946 below edge regions of the masked layer 950.

In other implementations, the cavity substrate 902 can be formed with an anisotropic removal operation. For example, the anisotropic removal operation can be realized with an anisotropic dry etching operation, photopatterning, or precision manufacturing. In such implementations, the resultant cavities as well as integrally-formed posts can have substantially vertical walls (or stepped walls using multiple masking and anisotropic removal operations).

Figure 9C:
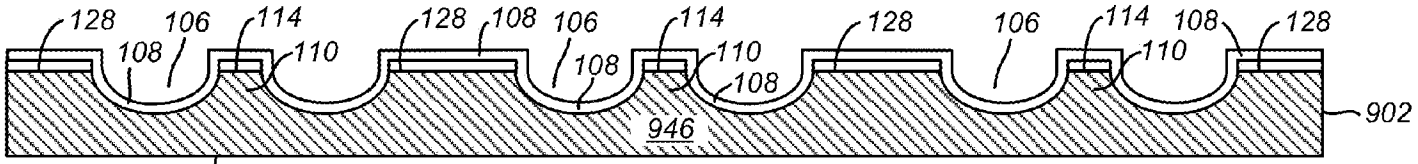
FIG. 9C shows a cross-sectional side view depiction of the example cavity substrate of FIG. 9B after a conductive plating operation.

In some implementations, the process 800 proceeds in block 806 with plating or otherwise depositing a conductive layer 108 on or over the inner surfaces of the cavities 106 and, in some implementations, on or over the posts 110, the distal or mating surfaces 114 of the posts 110, and on or over the mating surfaces 128. For example, the conductive layer 108 can be formed from Cu and have a thickness of approximately 10 μm. In various implementations, the conductive layer 108 also can be formed from Ni, Al, Ti, AlN, TiN, AlCu, Mo, AlSi, Pt, W, Ru, or other appropriate or suitable materials or combinations thereof and have a thickness in the range of approximately 1 μm to approximately 20 μm. FIG. 9C shows a cross-sectional side view depiction of the example cavity substrate of FIG. 9B after a conductive plating operation. In some implementations, the first masking layer 950 is removed prior to the plating operation in block 806.

Figure 9D:
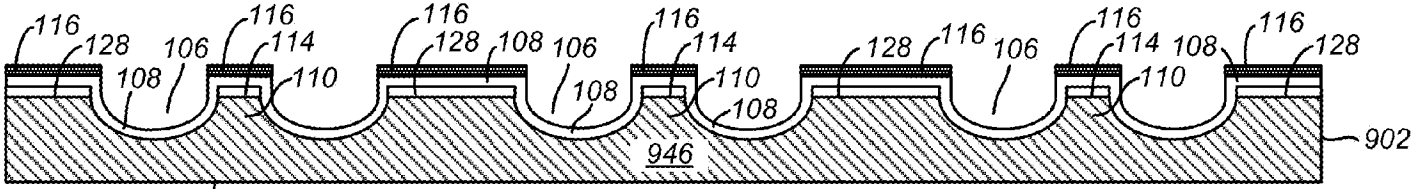
FIG. 9D shows a cross-sectional side view depiction of the example cavity substrate of FIG. 9C after a solder application operation.

In some implementations, the process 800 proceeds in block 808 with screen-printing laser-printing or otherwise depositing a solder layer 116 on or over the mating surfaces 114 and 128. FIG. 9D shows a cross-sectional side view depiction of the example cavity substrate of FIG. 9C after a solder application operation.

Although FIGS. 9A-9D are depicted for didactic purposes as including three lower cavity portions 102 along a length of the cavity substrate 902, in a variety of implementations, the cavity substrate 902 can include a two-dimensional array of tens, hundreds, thousands, or more of the lower cavity portions 102 and the corresponding cavities 106.

Additionally, as initially described above, in some implementations, an etch-stop can be applied to a back surface 952 of the cavity substrate 902. For example, an etch-stop can be formed on the back surface 952 of the bulk substrate portion 946 prior to the isotropic etching operation in block 804 as, for example, described above with reference to FIG. 6.

Referring back to the flow diagram of FIG. 7, in some implementations the two-substrate process 700 proceeds in block 704 with providing a second or "active" substrate 1004. For example, the substrate 1104 can include a plurality of the upper cavity portions 104.

Figure 10:
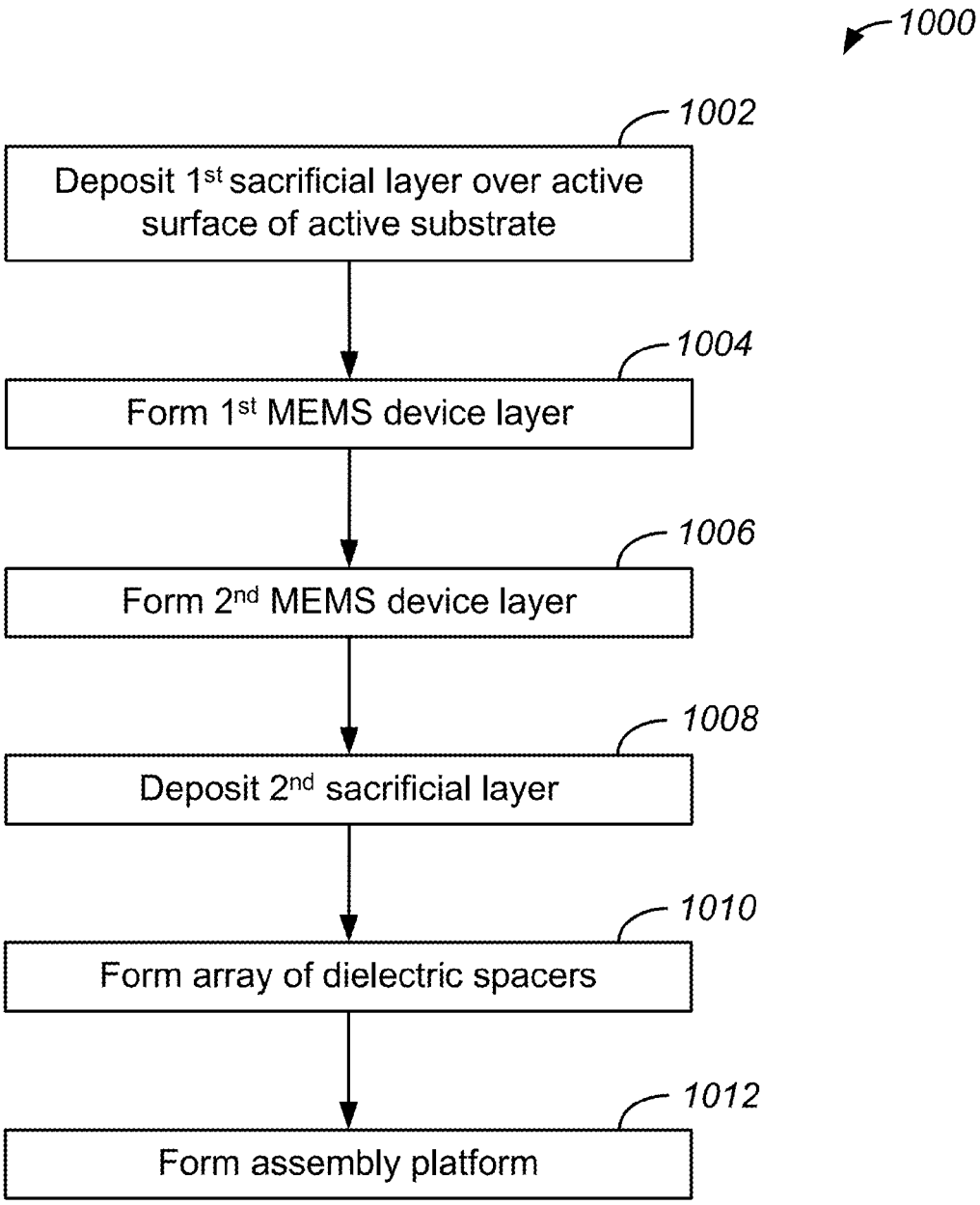
FIG. 10 shows a flow diagram depicting an example process for forming an example active substrate.
Figure 11A:
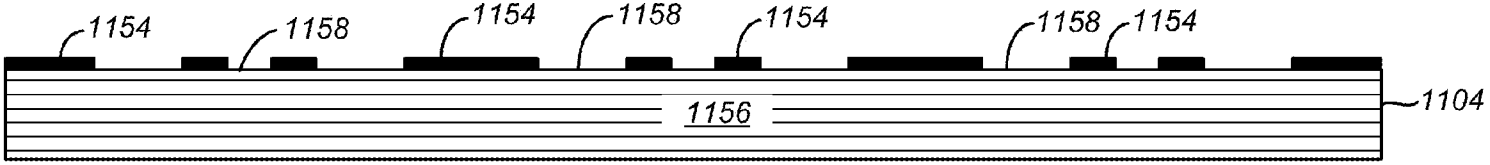
FIGS. 11A-11F show cross-sectional side view depictions of various example stages during the example process of FIG. 10.

FIG. 10 shows a flow diagram depicting an example process 1000 for forming an example active substrate 1104. FIGS. 11A-11F show example stages during the example process 1000 of FIG. 10. In some implementations, the process 1000 begins in block 1002 with depositing a first sacrificial layer 1154 over the active surface 1158 of the active substrate 1104. FIG. 11A shows a cross-sectional side view depiction of an example active substrate 1104. The active substrate 1104 includes a bulk substrate portion 1156. Upon the active surface 1158 can be deposited, patterned, grown, or otherwise formed an array of tuning elements 124, an array of dielectric spacers 126, and an assembly platform 112 that will serve as the post top, as described above with reference to FIG. 1.

In some implementations, the bulk substrate portion 1156 can be formed of an insulating or dielectric material. For example, the bulk substrate portion 1156 can be a low-cost, high-performance, large-area insulating substrate. In some implementations, the bulk substrate portion 1156 can be made of display-grade glass (such as alkaline earth boroaluminosilicate) or soda lime glass. Other suitable insulating materials from which the bulk substrate portion 1156 can be formed include silicate glasses, such as alkaline earth aluminosilicate, borosilicate, or modified borosilicate. Also, ceramic materials such as AlO, $Y_2O_3$, BN, SiC, AlN, and GaN also can be used in some implementations. In some other implementations, the bulk substrate portion 1156 can be formed of high-resistivity Si. In some implementations, SOI substrates, GaAs substrates, InP substrates, and plastic (polyethylene naphthalate or polyethylene terephthalate) substrates, e.g., associated with flexible electronics, also can be used. The bulk substrate portion 1156 also can be in conventional IC wafer form, e.g., 4-inch, 6-inch, 8-inch, 12-inch, or in large-area panel form. For example, flat panel display substrates with dimensions such as 370 mm×470 mm, 920 mm×730 mm, and 2850 mm×3050 mm, or larger, can be used.

In some implementations, the first sacrificial layer 1154 is formed from an etch-able material. For example, the sacrificial layer 1154 can be formed of a material such as molybdenum (Mo), amorphous silicon (a-Si), $SiO_2$, or a polymer. In some implementations, the sacrificial layer 1154 has a thickness in the range of approximately 250 Å to approximately 10000 Å.

Figure 11B:
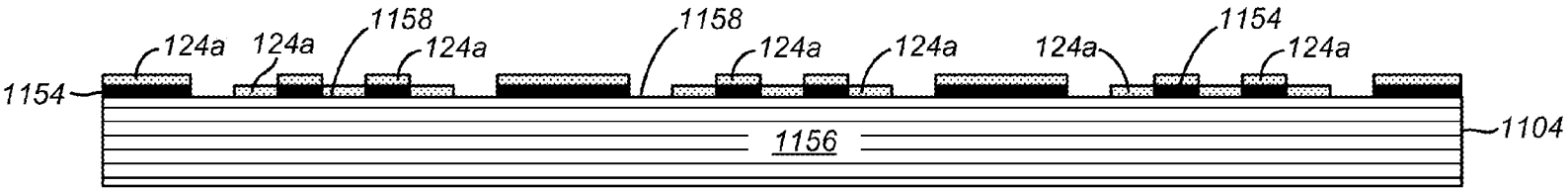
Figure 11C:
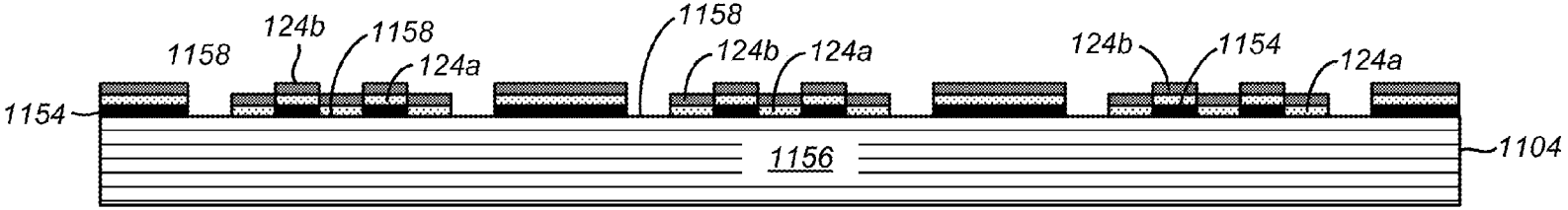

In some implementations, the process 1000 proceeds in block 1004 with depositing or otherwise forming a first MEMS device layer 124*a*, as shown in FIG. 11B. In some implementations, the process 1000 then proceeds in block 1006 with depositing or otherwise forming a second MEMS device layer 124*b*, as shown in FIG. 11C. In some implementations, one or both of the MEMS device layers 124*a* and 124*b* are formed from one or more piezoelectric layers such as, for example, one or more AlN layers. As another example, one or both of the MEMS device layers 124*a* and 124*b* can include one or more electrostatically-actuatable layers. One or both of MEMS device layers can be formed from, for example, amorphous silicon (a-Si), a-Si oxide or nitride, another dielectric, or a metal such as Ni or Al. In some implementations, one or both of MEMS device layers 124*a* and 124*b* can have a thickness in the range of approximately 0.25 μm to approximately 2 μm. In some implementation, the MEMS device layer 124*a* includes a structural layer formed of, for example, Ni having a thickness of, for example, 5 μm. In such an example, the MEMS device layer 124*b* can include one or more solderable layers formed from, for example, Au having a thickness of, for example, approximately 0.3 μm. In some implementations, the first and second MEMS device layers 124*a* and 124*b* result in the tuning elements 124 after further processing.

Figure 11D:
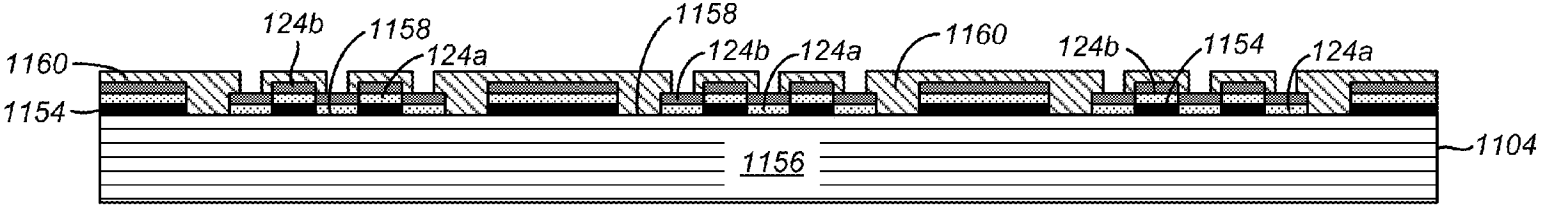

In some implementations, a second sacrificial layer 1160 can then be deposited, patterned, or otherwise formed in block 1008 over portions of the entire array of upper cavity portions 104, as shown in FIG. 11D. In some implementations, the second sacrificial layer 1160 is formed from an etch-able material. For example, the sacrificial layer 1160 can be formed of a material such as molybdenum (Mo), amorphous silicon (a-Si), $SiO_2$, or a polymer. In some implementations, the sacrificial layer 1160 has a thickness in the range of approximately 250 Å to approximately 10000 Å.

Figure 11E:
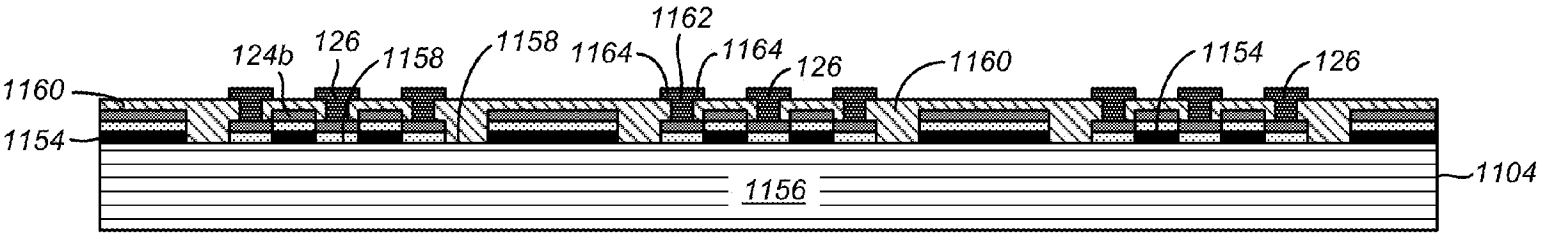
Figure 11F:
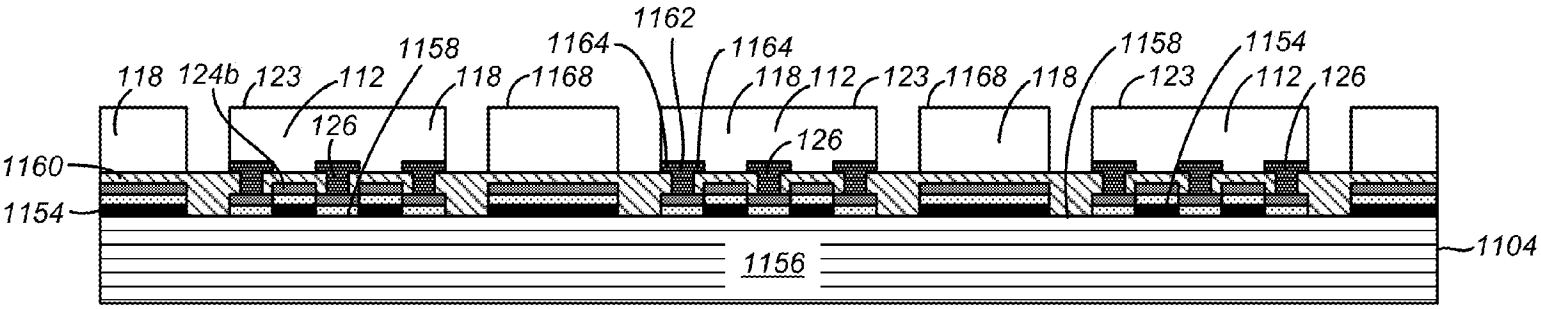

In some implementations, the process 1000 then proceeds in block 1010 with depositing, patterning, or otherwise forming or arranging an array of dielectric spacers 126 on or over the second MEMS device layer 124*b*, as shown in FIG. 11E. For example, first supporting portions 1162 of the dielectric spacers 126 can be formed at least partially over portions of the second MEMS device layer 124*b* that are not covered by the second sacrificial layer 1160. In such implementations, other wider portions 1164 of the dielectric spacers 126 can be formed at least partially over portions of the second sacrificial layer 1160. In some implementations, the process 1000 then proceeds in block 1012 with forming, positioning, or otherwise arranging and connecting an assembly platform 118 over the dielectric spacers 126 and the second sacrificial layer 1160, as shown in FIG. 11F.

Although FIGS. 11A-11F are depicted for didactic purposes as including three upper cavity portions 104 along a length of the active substrate 1104, in a variety of implementations, the active substrate 1104 can include a two-dimensional array of tens, hundreds, thousands, or more of the upper cavity portions 104 and the corresponding top posts 112.

Figure 12A:
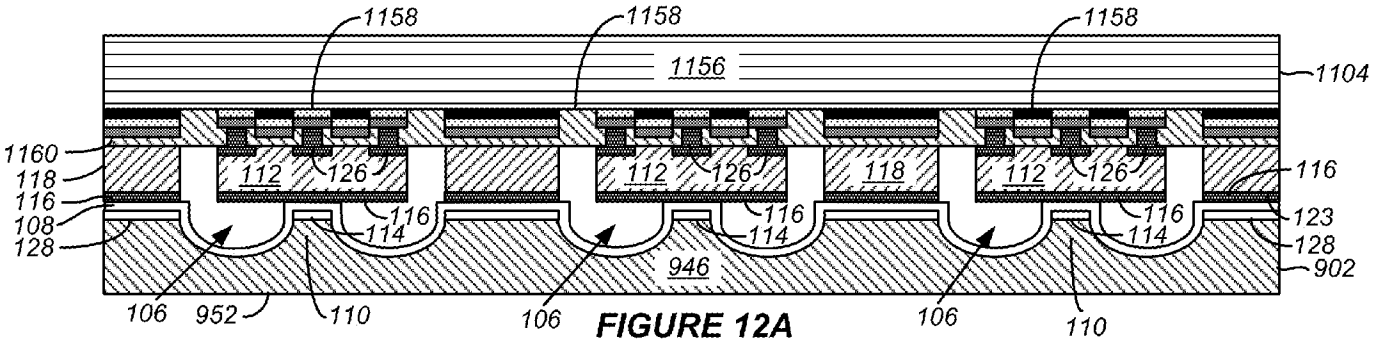
FIG. 12A shows a cross-sectional side view depiction of an example active substrate arranged over an example cavity substrate.

Referring back to FIG. 7, in some implementations, the process 700 proceeds in block 706 with arranging the mating side of the active substrate 1104 with the mating side of the cavity substrate 902. The active substrate 1104 can be arranged on or over the cavity substrate 902 such that the mating surfaces are aligned. FIG. 12A shows a cross-sectional side view depiction of the active substrate 1104 arranged over the cavity substrate 902. For example, in some implementations, the active substrate 1104 can be arranged over the cavity substrate 902 such that a proximal surface 123 of each of the post tops 112 is positioned over a corresponding distal surface 114 of an underlying post 110 and such that other mating surfaces 1168 of the assembly platform 118 are positioned over other mating surfaces 128 of the cavity substrate 902 (such as the mating surfaces 232 depicted in FIGS. 2A-2D) around the peripheries of the respective cavities 106.

In some implementations, the process 700 then proceeds in block 708 with physically and electrically connecting the distal surfaces 114 of the posts 110 with the proximal surfaces 123 of the corresponding post tops 112, and connecting the mating surfaces 128 (or 232) with the mating surfaces 1168 of the assembly platform 118. For example, in some implementations, the distal surfaces 114 of the posts 110 are soldered with the proximal surfaces 123 of the corresponding post tops 112 with the solder layer 116 in block 708, as shown in FIG. 12A. Similarly, in some implementations, the mating surfaces 128 (or 232) are soldered with the mating surfaces 1168 of the assembly platform 118 in block 708.

Figure 12B:
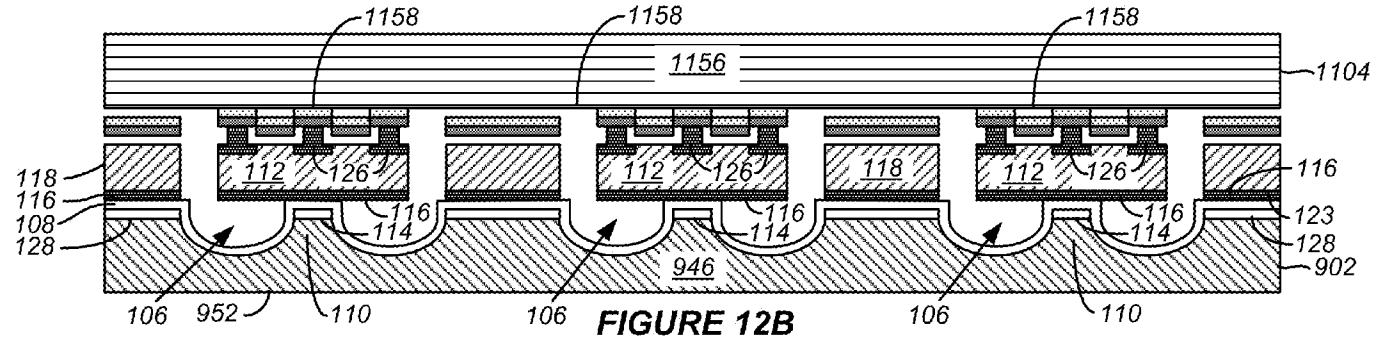
FIG. 12B shows a cross-sectional side view depiction of the arrangement of FIG. 12A after removing the sacrificial layers.

Subsequently, in some implementations, all or a portion of the first sacrificial layer 1154 can then be etched or otherwise removed in block 710 via a sacrificial release etch operation. Prior to, in parallel with, or after removing the first sacrificial layer 1154, all or a portion of the second sacrificial layer 1160 can be etched or otherwise removed in block 712. In some implementations, one or more release vents 1166 arranged, for example, periodically along the length or width of the substrate, can facilitate the removal of at least the second sacrificial layer 1160. FIG. 12B shows a cross-sectional side view depiction of the arrangement of FIG. 12A after removing the sacrificial layers 1154 and 1160. In some implementations, the cavities 106 are then vent-sealed.

In some implementations, the second sacrificial layer 1160 is removed such that portions of the assembly platform 118 become the post tops 112. Additionally, in some implementations, the second sacrificial layer 1160 can be removed such that the post tops 112 are not in direct contact with the tuning elements 124. In some such implementations, the second sacrificial layer 1160 can be removed such that the only parts on the active surface 1158 of the substrate that the post tops 112 directly contact are the dielectric spacers 126. In some such implementations, the second sacrificial layer 1160 can be removed such that the dielectric spacers 126 connect to the active surface 1158 via the tuning elements 124 only. That is, in some implementations, the first and second sacrificial layers 1154 and 1160 are removed to release the MEMS tuning elements 124 from the active surface 1158 of the first substrate, and also to release the MEMS tuning elements 124 from the post tops 112. The first and second sacrificial layers 1154 and 1160 can be removed using processes such as isotropic wet or dry etches. In some such implementations, this leaves the dielectric spacers 126 as the only structures mechanically connecting the MEMS tuning elements 124 with the post tops 112.

Figure 12C:
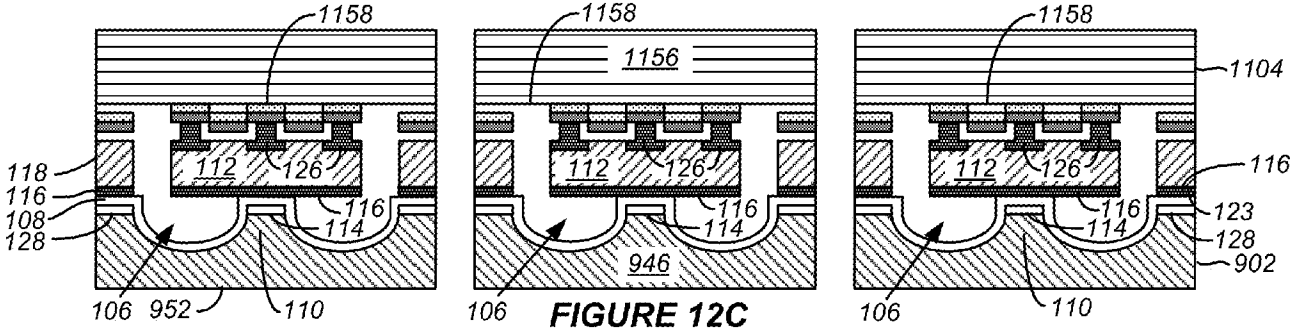
FIG. 12C shows a cross-sectional side view depiction of the arrangement of FIG. 12B after one or more singulation operations.

In some implementations, the process 700 can then end with sawing, cutting, dicing, or otherwise singulating the entire array in block 714 to provide one or more arrays of one or more cavity resonators 100. FIG. 12C shows a cross-sectional side view depiction of the arrangement of FIG. 12B after one or more singulation operations.

Although FIG. 12C is depicted for didactic purposes as including three cavity resonators 100, in a variety of implementations, the result of the process 700 can include a two-dimensional array of tens, hundreds, thousands, or more cavity resonators 100.

As described above with reference to FIG. 1A and FIG. 1B, the tuning elements 124 can be arranged as one or more arrays of one or more tuning elements 124. In some implementations, each tuning element is or functions as a bi-state device, varactor, or bit that is individually or otherwise electrostatically- or piezoelectrically-actuatable. In some other implementations, each array of tuning elements 124 is or functions as a bi-state device, varactor, or bit that is electrostatically- or piezoelectrically-actuatable at an array level. In some implementations, each tuning element 124 includes one or more MEMS that are individually or otherwise electrostatically- or piezoelectrically-actuatable. By selectively actuating one or more of the tuning elements 124 to one or more activated states, the tuning elements 124 can be used to selectively change the actual or effective magnitude of the gap distance or spacing, g, between the post top 112 and the cavity ceiling 120 to selectively effectuate a change in the capacitance between the post top 112 and the cavity ceiling. By changing this capacitance, the tuning elements 124 can be used to change one or more evanescent electromagnetic wave modes of the cavity resonator 100 and thus tune the resonant frequency of the cavity resonator 100.

In some implementations, the combined thickness of the spacers 126 and the overlying tuning elements 124 define a static un-actuated magnitude of the gap spacing g. In some implementations, by actuating selected ones of the tuning elements 124, the actual or effective gap spacing g can be increased, thereby decreasing the effective capacitance. In some implementations, by actuating selected ones of the tuning elements 124, the actual or effective gap spacing g can be decreased, thereby increasing the effective capacitance. In such implementations, the statically-defined or baseline magnitude of the gap spacing g is process-defined as opposed to assembly-defined. More specifically, the gap spacing g can be accurately and reproducibly defined by way of process techniques used during the formation of the upper cavity portion 104. For example, the gap spacing g can be defined at least in part by the thickness of the dielectric spacers 126 and the patterning and subsequent removal of the sacrificial layers 1154 and 1160. Uniformity and accuracy of the gap spacings among the resultant cavity resonators 100 of the entire array is also ensured because the surfaces 123 and 1168 are coplanar with one another and because the surfaces 114 and 128 (232) are coplanar with one another. This enables the surfaces 123 and 1168 to be connected with the surfaces 114 and 128 (232), respectively, in one parallel operation across the entire array of cavity resonators 100.

Figure 13:
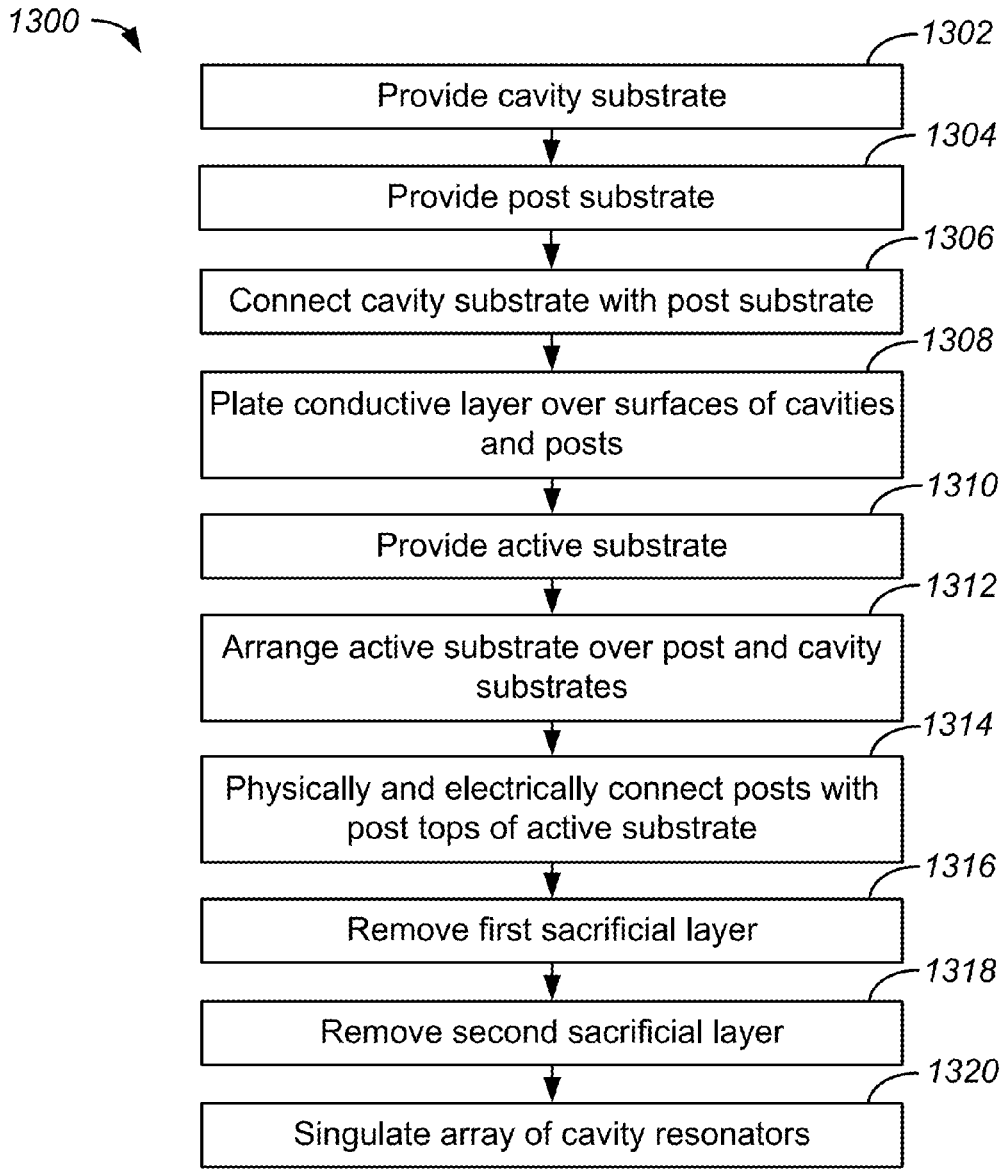
FIG. 13 shows a flow diagram depicting an example three-substrate process for forming a multiplicity of evanescent-mode electromagnetic-wave cavity resonators.

FIG. 13 shows a flow diagram depicting an example three-substrate process 1300 for forming a multiplicity of evanescent-mode electromagnetic-wave cavity resonators. For example, process 1300 can be used to produce a multiplicity of the cavity resonators 100 as shown in FIGS. 1A and 1B. In one example three-substrate implementation, the active substrate 1104 is produced as described above, but rather than using a single integrally-combined cavity and post substrate, the substrate 902 is replaced in the process with two distinct substrates: a cavity substrate 1502 and a separate post substrate 1702. In some implementations, the three-substrate process 1300 begins in block 1302 with providing the first cavity substrate 1502.

Figure 14:
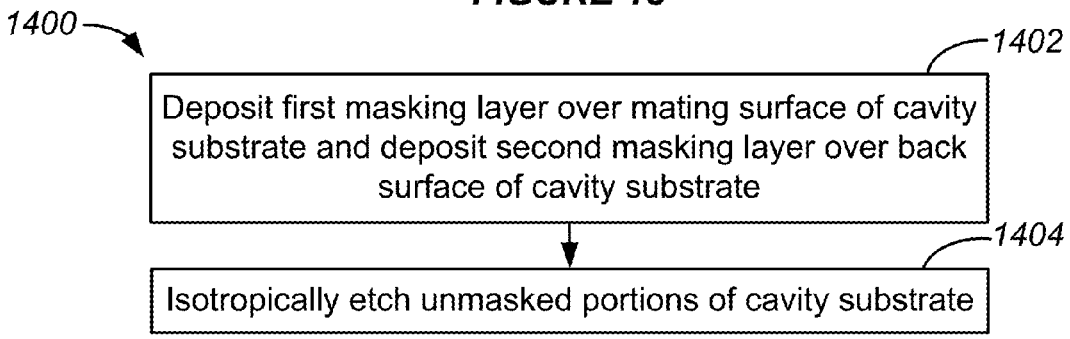
FIG. 14 shows a flow diagram depicting an example process for forming an example cavity substrate.
Figure 15A:
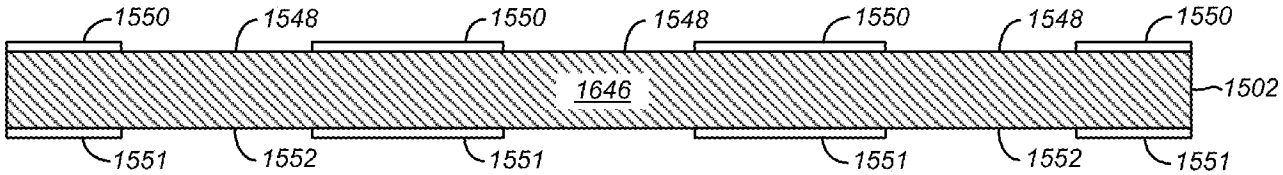
FIG. 15A shows a cross-sectional side view depiction of an example cavity substrate.

FIG. 14 shows a flow diagram depicting an example process 1400 for forming an example cavity substrate 1502. FIG. 15A shows a cross-sectional side view depiction of an example cavity substrate 1502. The cavity substrate 1502 includes a first bulk substrate portion 1546 having a mating surface 1548 and a back surface 1552. In some implementations, the process 1400 begins in block 1402 with depositing a first masking layer 1550 over the mating surface 1548 of the cavity substrate 1502 and, prior to, after, or in parallel with depositing the first masking layer 1550, depositing a second masking layer 1551 over the back surface 1552 as depicted in FIG. 15A. In some implementations, one or both of the masking layers 1550 and 1551 can be a positive or negative photolithographic photoresist. In some other implementations, the masking layers 1550 and 1551 can be formed from Si. In still other implementations, the masking layers 1550 and 1551 can be formed from a metal that is not etched or etchable by the etchant that will be used to etch the substrate 1546.

Figure 15B:
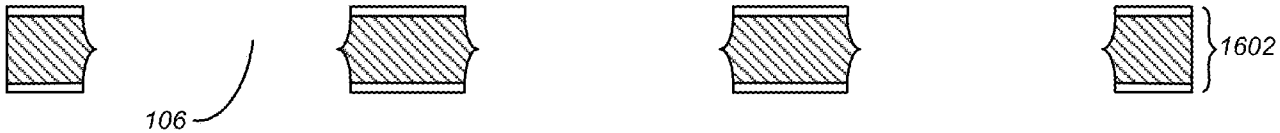
FIG. 15B shows a cross-sectional side view depiction of the example cavity substrate of FIG. 15A after an isotropic etching operation.

In some implementations, the process 1400 proceeds in block 1404 with isotropically etching the unmasked portions of the surface 1548 of the bulk substrate portion 1546 and, prior to, after, or in parallel with isotropically etching the unmasked portions of the surface 1548, isotropically etching the unmasked portions of the surface 1552. In some implementations, the isotropic etching operations in block 1404 can be isotropic wet etching operations. For example, FIG. 15B shows a cross-sectional side view depiction of the example cavity substrate 1502 of FIG. 15A after an isotropic etching operation. As shown in FIG. 15B, after the isotropic etching operation, the cavity substrate 1502 includes a plurality of cavities 106 that extend through the entire substrate 1502.

In some other implementations, the cavity substrate 1502 can be formed with an anisotropic removal operation. For example, the anisotropic removal operation can be realized with an anisotropic dry etching operation, photopatterning, or precision manufacturing. In such implementations, the resultant cavities as well as integrally-formed posts can have substantially vertical walls. Additionally, as described above, in some implementations, an etch-stop can be applied to a back surface 1552 of the cavity substrate 1502. For example, an etch-stop can be formed on the back surface 1552 of the bulk substrate portion 1546 prior to the isotropic etching operation in block 1404 as, for example, described above with reference to FIG. 6. In some implementations, the etch-stop can then be removed before further processing.

Figure 16:
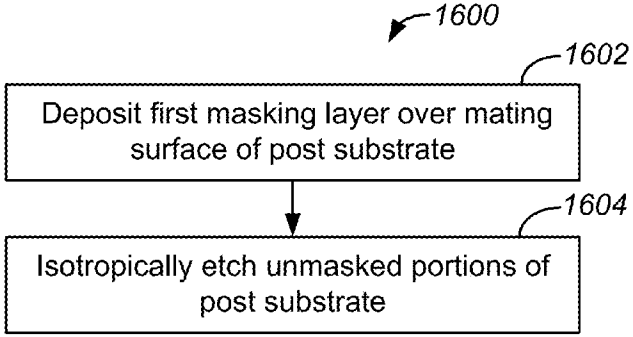
FIG. 16 shows a flow diagram depicting an example process for forming an example post substrate.
Figure 17A:
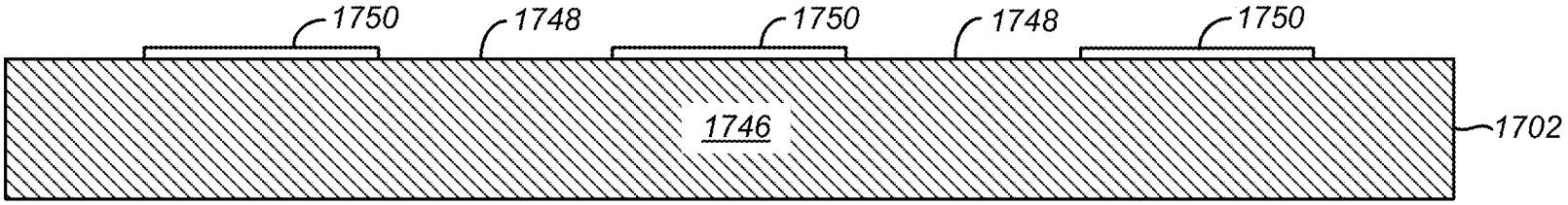
FIG. 17A shows a cross-sectional side view depiction of an example post substrate.

Referring back to the flow diagram of FIG. 13, in some implementations the three-substrate process 1300 proceeds in block 1304 with providing the post substrate 1702. FIG. 16 shows a flow diagram depicting an example process 1600 for forming an example post substrate 1702. FIG. 17A shows a cross-sectional side view depiction of an example post substrate 1702. The post substrate 1702 includes a first bulk substrate portion 1746 having a mating surface 1748 and a back surface 1752. In some implementations, the process 1600 begins in block 1602 with depositing a first masking layer 1750 over the mating surface 1748 of the post substrate 1702 as depicted in FIG. 17A. In some implementations, the masking layers 1750 can be a positive or negative photolithographic photoresist. In some other implementations, the masking layer 1750 can be formed from Si. In still other implementations, the masking layers 1750 can be formed from a metal that is not etched or etchable by the etchant that will be used to etch the substrate 1746.

Figure 17B:
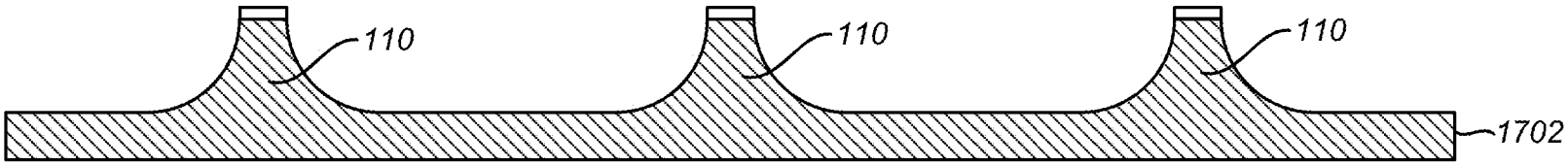
FIG. 17B shows a cross-sectional side view depiction of the example post substrate of FIG. 17A after an isotropic etching operation.

In some implementations, the process 1600 proceeds in block 1604 with isotropically etching the unmasked portions of the surface 1748 of the bulk substrate portion 1746. In some implementations, the isotropic etching operation in block 1604 can be an isotropic wet etching operation. For example, FIG. 17B shows a cross-sectional side view depiction of the example post substrate 1702 of FIG. 17A after an isotropic etching operation. As shown in FIG. 17B, after the isotropic etching operation, the post substrate 1702 includes a plurality of posts 110.

In some other implementations, the cavity substrate 1502 can be formed with an anisotropic removal operation. For example, the anisotropic removal operation can be realized with an anisotropic dry etching operation, photopatterning, or precision manufacturing. In such implementations, the resultant cavities as well as integrally-formed posts can have substantially vertical walls.

In some implementations, the bulk substrate portions 1546 and 1746 can be formed of an insulating or dielectric material. For example, the bulk substrate portions 1546 and 1746 can be low-cost, high-performance, large-area insulating substrates. In some implementations, the bulk substrate portions 1546 and 1746 can be made of display-grade glass (such as alkaline earth boro-aluminosilicate) or soda lime glass. Other suitable insulating materials from which the bulk substrate portions 1546 and 1746 can be formed include silicate glasses, such as alkaline earth aluminosilicate, borosilicate, or modified borosilicate. Also, ceramic materials such as AlO, $Y_2O_3$, BN, SiC, AlN, and GaN also can be used in some implementations. In some other implementations, the bulk substrate portions 1546 and 1746 can be formed of high-resistivity Si. In some implementations, SOI substrates, GaAs substrates, InP substrates, and plastic (polyethylene naphthalate or polyethylene terephthalate) substrates, e.g., associated with flexible electronics, also can be used. The bulk substrate portions 1546 and 1746 also can be in conventional IC wafer form, e.g., 4-inch, 6-inch, 8-inch, 12-inch, or in large-area panel form. For example, flat panel display substrates with dimensions such as 370 mm×470 mm, 920 mm×730 mm, and 2850 mm×3050 mm, or larger, can be used.

Figure 18A:
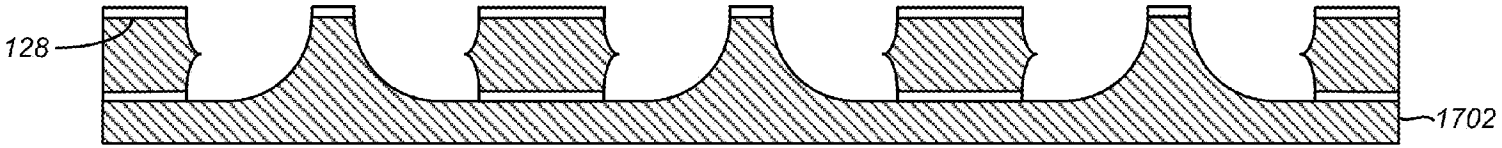
FIG. 18A shows a cross-sectional side view depiction of the post substrate of FIG. 17B arranged over and connected with the cavity substrate of FIG. 15B.

Referring back to the flow diagram of FIG. 13, in some implementations the three-substrate process 1300 proceeds in block 1306 with connecting the cavity substrate 1502 with the post substrate 1702. FIG. 18A shows a cross-sectional side view depiction of the post substrate 1702 of FIG. 17B arranged over and connected with the cavity substrate 1502 of FIG. 15B. In some implementations, the back surface 1552 of the cavity substrate 1502 is connected with the post substrate 1702 by means of an adhesive layer. For example, the adhesive layer can be an epoxy layer. The epoxy can conform to variations in the substrate thickness or etch depth, ensuring the assembly presents coplanar surfaces to which can be attached the active substrate 1104.

In some other implementations, the back surface 1552 of the cavity substrate 1502 is soldered with the post substrate 1702. For example, solder can be previously screen-printed, laser-printed or otherwise deposited on the back surface 1552 or the region of the post substrate 1702 below the cavity substrate 1502.

Figure 18B:
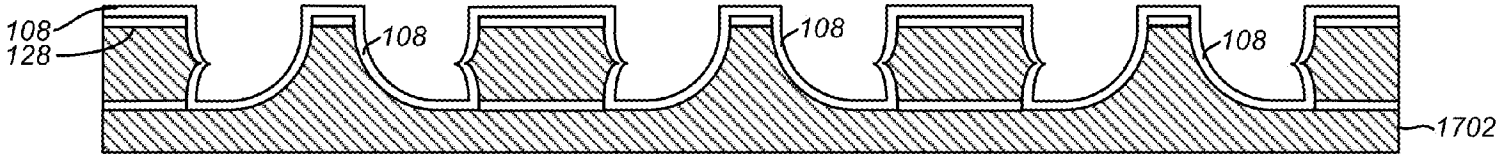
FIG. 18B shows a cross-sectional side view depiction of the arrangement of FIG. 18A after a conductive plating operation.

Referring back to the flow diagram of FIG. 13, in some implementations the three-substrate process 1300 proceeds in block 1308 with plating or otherwise depositing a conductive layer 108 on or over the inner surfaces of the cavities 106 and, in some implementations, on or over the posts 110, the distal or mating surfaces 114 of the posts 110, and on or over the mating surfaces 128. For example, the conductive layer 108 can be formed from Cu and have a thickness of approximately 10 μm. In various implementations, the conductive layer 108 also can be formed from Ni, Al, Ti, AlN, TiN, AlCu, Mo, AlSi, Pt, W, Ru, or other appropriate or suitable materials or combinations thereof and have a thickness in the range of approximately 1 μm to approximately 20 μm. FIG. 18B shows a cross-sectional side view depiction of the arrangement of FIG. 18A after a conductive plating operation. In some other implementations, the conductive layers can be deposited over the cavity substrate 1502 or the post substrate 1702 prior to connecting the post substrate 1702 with the cavity substrate 1502.

Figure 18C:
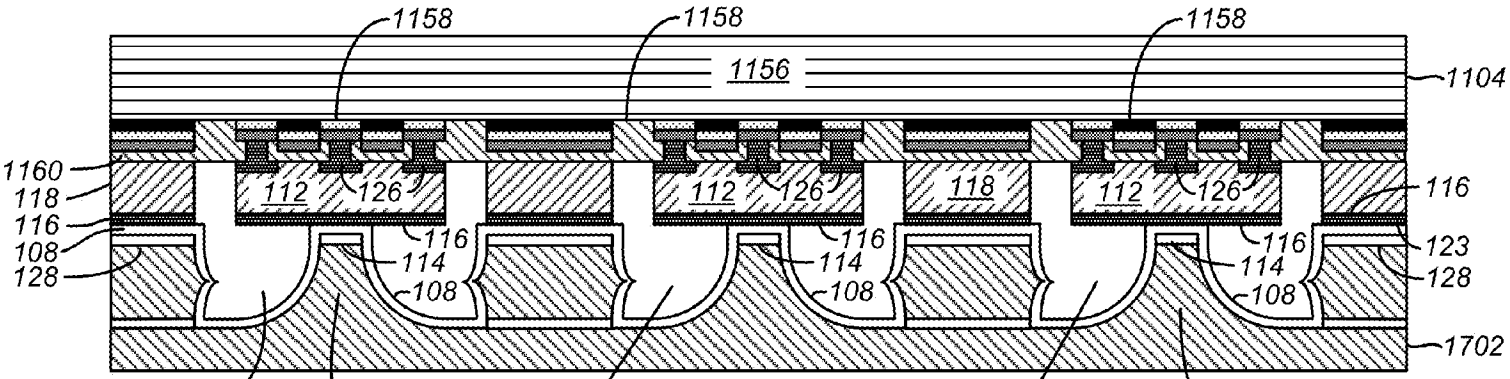
FIG. 18C shows a cross-sectional side view depiction of the active substrate of FIG. 11F arranged over the cavity and post substrates and of FIGS. 15B and 17B.

Referring back to the flow diagram of FIG. 13, in some implementations the three-substrate process 1300 proceeds in block 1310 with providing the active substrate 1004. In some implementations, process 1300 then proceeds in block 1312 with arranging the mating side of the active substrate 1104 with the mating side of the arrangement of FIG. 18B. FIG. 18C shows a cross-sectional side view depiction of the active substrate 1104 of FIG. 11F arranged over the cavity and post substrates 1502 and 1702 of FIGS. 15B and 17B. For example, the active substrate 1104 can be arranged over and in proximity to the post substrate 1702 such that a proximal surface 123 of each post top 112 is positioned over a corresponding distal surface 114 of an underlying post 110 and over the cavity substrate such that other mating surfaces 1168 of the assembly platform 118 are positioned over other mating surfaces 128 of the cavity substrate 1502 around the peripheries of the respective cavities 106.

In some implementations, process 1300 then proceeds in block 1314 with physically and electrically connecting the distal surfaces 114 of the posts 110 with the proximal surfaces 123 of the corresponding post tops 112, and connecting the mating surfaces 128 with the mating surfaces 1168 of the assembly platform 118. For example, in some implementations, the distal surfaces 114 of the posts 110 are soldered with the proximal surfaces 123 of the corresponding post tops 112 with a solder layer 116 in block 1314. Similarly, in some implementations, the mating surfaces 128 are soldered with the mating surfaces 1168 of the assembly platform 118 in block 1314.

Figure 18D:
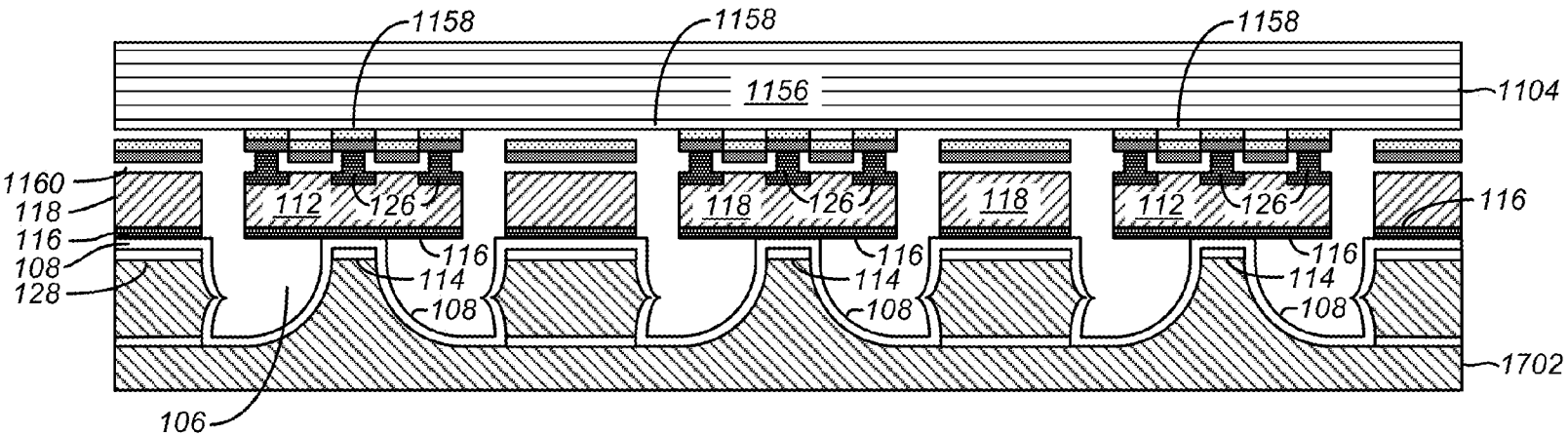
FIG. 18D shows a cross-sectional side view depiction of the arrangement of FIG. 18C after removing the sacrificial layers.

Subsequently, in some implementations, all or a portion of the first sacrificial layer 1154 can then be etched or otherwise removed in block 1316 via a sacrificial release etch operation. Prior to, in parallel with, or after removing the first sacrificial layer 1154, all or a portion of the second sacrificial layer 1160 can be etched or otherwise removed in block 1318. In some implementations, one or more release vents 1166 arranged, for example, periodically along the length or width of the substrate, can facilitate the removal of at least the second sacrificial layer 1160. FIG. 18D shows a cross-sectional side view depiction of the arrangement of FIG. 18C after removing the sacrificial layers 1154 and 1160. In some implementations, the cavities 106 are then vent-sealed.

In some implementations, the second sacrificial layer 1160 is removed such that portions of the assembly platform 118 become the post tops 112. Additionally, in some implementations, the second sacrificial layer 1160 can be removed such that the post tops 112 are not in direct contact with the tuning elements 124. In some such implementations, the second sacrificial layer 1160 can be removed such that the only parts on the active surface 1158 of the substrate that the post tops 112 directly contact are the dielectric spacers 126. In some such implementations, the second sacrificial layer 1160 can be removed such that the dielectric spacers 126 connect to the active surface 1158 via the tuning elements 124 only. That is, in some implementations, the first and second sacrificial layers 1154 and 1160 are removed to release the MEMS tuning elements 124 from the active surface 1158 of the first substrate, and also to release the MEMS tuning elements 124 from the post tops 112. The first and second sacrificial layers 1154 and 1160 can be removed using processes such as isotropic wet or dry etches. In some such implementations, this leaves the dielectric spacers 126 as the only structures mechanically connecting the MEMS tuning elements 124 with the post tops 112.

Figure 18E:
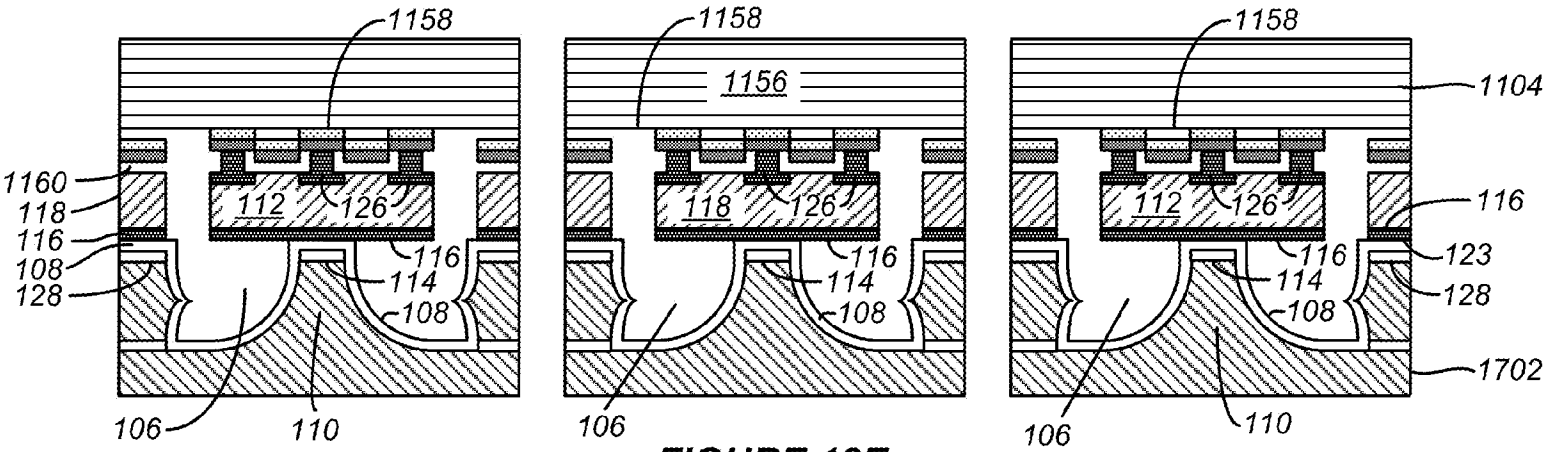
FIG. 18E shows a cross-sectional side view depiction of the arrangement of FIG. 18D after one or more singulation operations.

In some implementations, the process 1300 can then end with sawing, cutting, dicing, or otherwise singulating the entire array in block 1320 to provide one or more arrays of one or more cavity resonators 100. FIG. 18E shows a cross-sectional side view depiction of the arrangement of FIG. 18D after one or more singulation operations. As compared with the cavity resonators 100 of FIG. 1 or those produced according to the methods of process 700, the cavity resonators of FIG. 18E and produced according to the methods of processes 1300, 1400, and 1500 can have increased cavity volumes 106 for a given cavity radius b, and, as a result, possibly achieve a higher Q factor.

Although FIG. 18E is depicted for didactic purposes as including three cavity resonators 100, in a variety of implementations, the result of process 1300 can include a two-dimensional array of tens, hundreds, thousands, or more cavity resonators 100.

Further cost savings can be realized by fabricating the cavity or post substrates in a coarser technology node than the active substrate. In other implementations, the cavity and post substrates can be patterned by micro-sandblasting, micro-embossing or can be formed from photo-patterned glass. The substrates also can be formed of polymer or metal materials enabling roll-to-roll fabrication.

While the aforementioned implementations have been described with reference to cavity resonator post designs in which the posts extend "vertically" from a substrate portion of the cavity resonator, as initially presented above, some example implementations also can include lithographically-patterned in-plane resonator structures. In some implementations, an in-plane resonator structure refers to a resonator structure that extends along a plane parallel with a cavity mating surface. For example, an in-plane resonator structure can include a radially- or transversely-extending post that extends from an outer circumference of the cavity along a plane parallel to a mating surface of the cavity inward or across a portion of the cavity volume. In some implementations, lithographic processes are used to produce in-plane resonator structures having a gap spacing g whose base or steady-state dimension is lithographically-defined concurrently with the remaining portions of the resonator structure.

Figure 19:
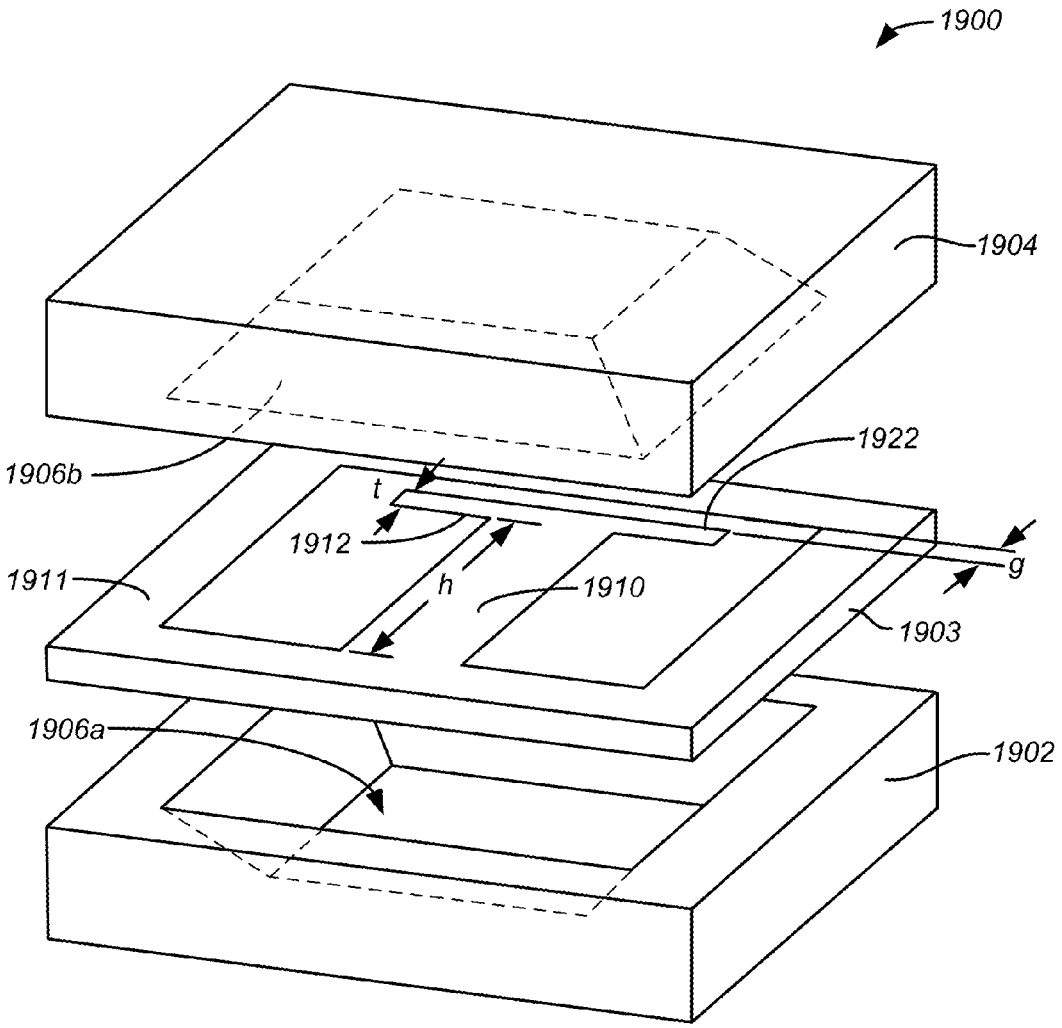
FIG. 19 shows an exploded axonometric view depiction of an example cavity resonator that includes a lithographically-defined in-plane capacitive tuning structure.
Figure 20A:
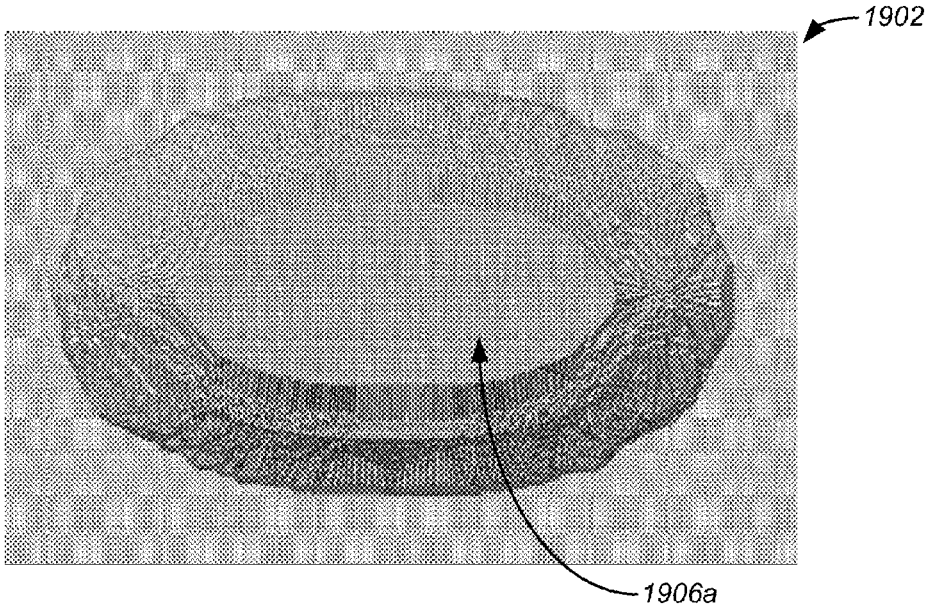
FIG. 20A shows a top view of a simulation of an example lower cavity portion such as that usable in the cavity resonator of FIG. 19.

FIG. 19 shows an exploded axonometric view depiction of an example cavity resonator 1900 that includes a lithographically-defined in-plane capacitive tuning structure or post 1910. The cavity resonator 1900 includes a lower cavity portion 1902, a post structure portion 1903, and an upper cavity portion 1904. The lower cavity portion 1902 includes a lower cavity volume 1906*a*. Similarly, in some implementations, the upper cavity portion 1904 includes an upper cavity volume 1906*b* (hidden from view in FIG. 19) that, in conjunction with the lower cavity volume 1906*a* and the post structure portion 1903, define a total cavity volume. In some implementations, the upper cavity portion 1904 or the upper cavity volume 1906*b* is substantially a mirror image of the lower cavity portion 1902 or the lower cavity volume 1906*a*. FIG. 20A shows a top view of a simulation of an example lower cavity portion 1902 such as that usable in the cavity resonator 1900 of FIG. 19.

In some implementations, the lower and upper cavity volumes 1906*a* and 1906*b* are formed at an array or batch level from respective cavity substrates through respective etching operations. In some implementations, the lower cavity portion 1902 and the upper cavity portion 1904 are each formed via an isotropic wet-etching operation resulting in curved cavity walls and a substantially spherical or ellipsoidal total cavity volume. In some other implementations, the lower cavity portion 1902 and the upper cavity portion 1904 are each formed through an anisotropic etching operation resulting in substantially straight or vertical cavity walls. In some implementations, the lower cavity portion 1902 and the upper cavity portion 1904 are vent-sealed, evacuated of air or filled with other gas.

In some implementations, the bulk substrate portions of the lower cavity portion 1902 or the upper cavity portion 1904 can be formed of an insulating or dielectric material. For example, in some implementations, the bulk substrate portions of the lower cavity portion 1902 or the upper cavity portion 1904 can be made of display-grade glass (such as alkaline earth boro-aluminosilicate) or soda lime glass. Other suitable insulating materials include silicate glasses, such as alkaline earth aluminosilicate, borosilicate, or modified borosilicate. Also, ceramic materials such as aluminum oxide (AlOx), yttrium oxide ($Y_2O_3$), boron nitride (BN), silicon carbide (SiC), aluminum nitride (AlN), and gallium nitride (GaNx) also can be used in some implementations. In some other implementations, high-resistivity Si can be used. In some implementations, silicon on insulator (SOI) substrates, gallium arsenide (GaAs) substrates, indium phosphide (InP) substrates, and plastic (polyethylene naphthalate or polyethylene terephthalate) substrates, e.g., associated with flexible electronics, also can be used.

In some implementations, the lower cavity portion 1902 and the upper cavity portion 1904 are plated with one or more conductive layers. For example, the conductive layers can be formed by plating the surface of the lower cavity portion 1902 and the surface of the upper cavity portion 1904 with a conductive metal or metallic alloy. For example, the conductive layers can be formed from nickel (Ni), aluminum (Al), copper (Cu), titanium (Ti), aluminum nitride (AlN), titanium nitride (TiN), aluminum copper (AlCu), molybdenum (Mo), aluminum silicon (AlSi), platinum (Pt), tungsten (W), ruthenium (Ru), or other appropriate or suitable materials or combinations thereof. In some implementations, a thickness in the range of approximately 1 μm to approximately 10 μm can be suitable. However, thinner or thicker thicknesses may be appropriate or suitable in other implementations or applications.

Figure 20B:
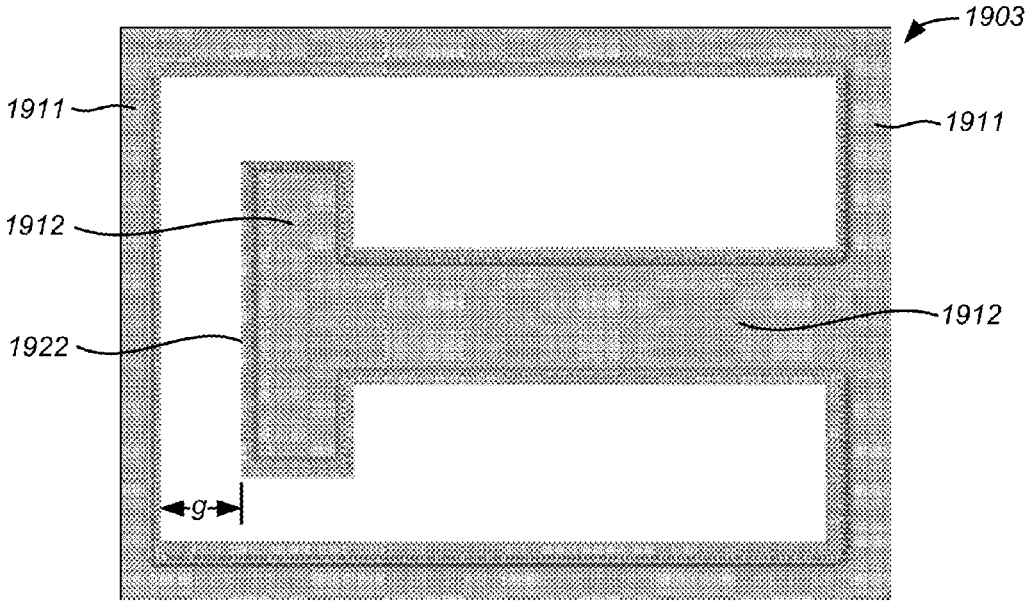
FIG. 20B shows a top view of a simulation of an example lithographically-defined in-plane capacitive tuning structure such as that usable in the cavity resonator of FIG. 19.

The post structure 1903 includes a lithographically-defined in-plane capacitive tuning structure or post 1910 that extends transversely across the cavity volume culminating at a distal end of the post 1910 in an integrally-formed top post 1912. The post structure 1903 can be supported by the support ring structure 1911. FIG. 20B shows a top view of a simulation of an example lithographically-defined in-plane capacitive tuning structure such as that usable in the cavity resonator of FIG. 19.

The post 1910 and the support ring structure 1911 can be formed by lithographic processing techniques such as patterning and etching. In some implementations, the post structure 1903 also is formed of a dielectric material. In some other implementations, the post structure 1903 can be formed of a semiconducting or conductive material. The post 1910 and the post top 1912 also can be plated with one or more conductive layers. In various implementations, the post structure 1903, including the post 1910 and the post top 1912, can have a thickness in the range of approximately 50 μm to approximately 500 μm.

The post top 1912 has a wider dimension than the post 1910. For example, in some applications, the post 1910 can have a width at the distal end of the post 1910 of approximately 0.5 mm. In such applications, or others, the post top 1912 can have a width of approximately 2 mm. That is, in some implementations, the diameter or width of the post top 1912 is significantly larger than the diameter or width of the integrally-attached post 1910. In some implementations, the post top 1912 can have a width in the range of approximately 1 mm to approximately 3 mm while the post 1910 can have a width in the range of approximately 0.1 mm to approximately 1 mm. In some implementations, the post top 1912 can have a length in the range of approximately 0.1 mm to approximately 1 mm while the post 1910 can have a length in the range of approximately 1 mm to approximately 5 mm. Additionally in some implementations, the post 1910 or the post top 1912 can be formed so as to have a different thickness than the support ring structure 1911.

One or more evanescent electromagnetic-wave modes, and corresponding resonant frequencies, of the cavity resonator 1900 may be dependent on the gap spacing g between the distal surface 1922 of the post top 1912 and the portion of the inner surface of the cavity defined by the inner surface of the support ring structure 1911 adjacent the post top 1912. As described, because the gap spacing g is lithographically-defined, the gap spacing g can be accurately and reproducibly controlled. For example, a ratio of a combined sum of the post length h and top post length t to the gap spacing g can readily be 1000:1.

In particular implementations, one or more tuning elements or devices are formed or arranged within the gap spacing g. For example, an array of tuning elements can be connected to the post top 1912 or, additionally or alternately, to the support ring structure 1911. In some other implementations, the tuning elements may be connected only with the post top 1912 but not to the support ring structure 1911. In some other implementations, the tuning elements may be connected only with the support ring structure 1911 but not to the post 1910 or the post top 1912.

In some implementations, the tuning elements can be arranged as one or more arrays of one or more tuning elements as described above. In some implementations, each tuning element is or functions as a bi-state device, varactor, or bit that is individually or otherwise electrostatically- or piezoelectrically-actuatable. In some other implementations, each array of tuning elements is or functions as a bi-state device, varactor, or bit that is electrostatically- or piezoelectrically-actuatable at an array level. In some implementations, each tuning element includes one or more MEMS that are individually or otherwise electrostatically- or piezoelectrically-actuatable. By selectively actuating ones of the tuning elements to one or more activated states, the tuning elements can be used to selectively change the actual or effective magnitude of the gap distance or spacing, g, in order to selectively effectuate a change in the capacitance between the post top 1912 and the support ring structure 1911. By changing this capacitance, the tuning elements can be used to change one or more evanescent electromagnetic wave modes of the cavity resonator 1900 and thus tune the resonant frequency of the cavity resonator 1900. In some implementations, by actuating selected ones of the tuning elements, the gap spacing g can be increased, thereby decreasing the effective capacitance. In some implementations, by actuating selected ones of the tuning elements, the gap spacing g can be decreased, thereby increasing the effective capacitance.

In such implementations, the statically-defined or baseline magnitude of the gap spacing g is process-defined as opposed to assembly-defined. More specifically, the gap spacing g can be accurately and reproducibly defined by way of lithographic process techniques used during the formation of the post substrate.

Figure 20C:
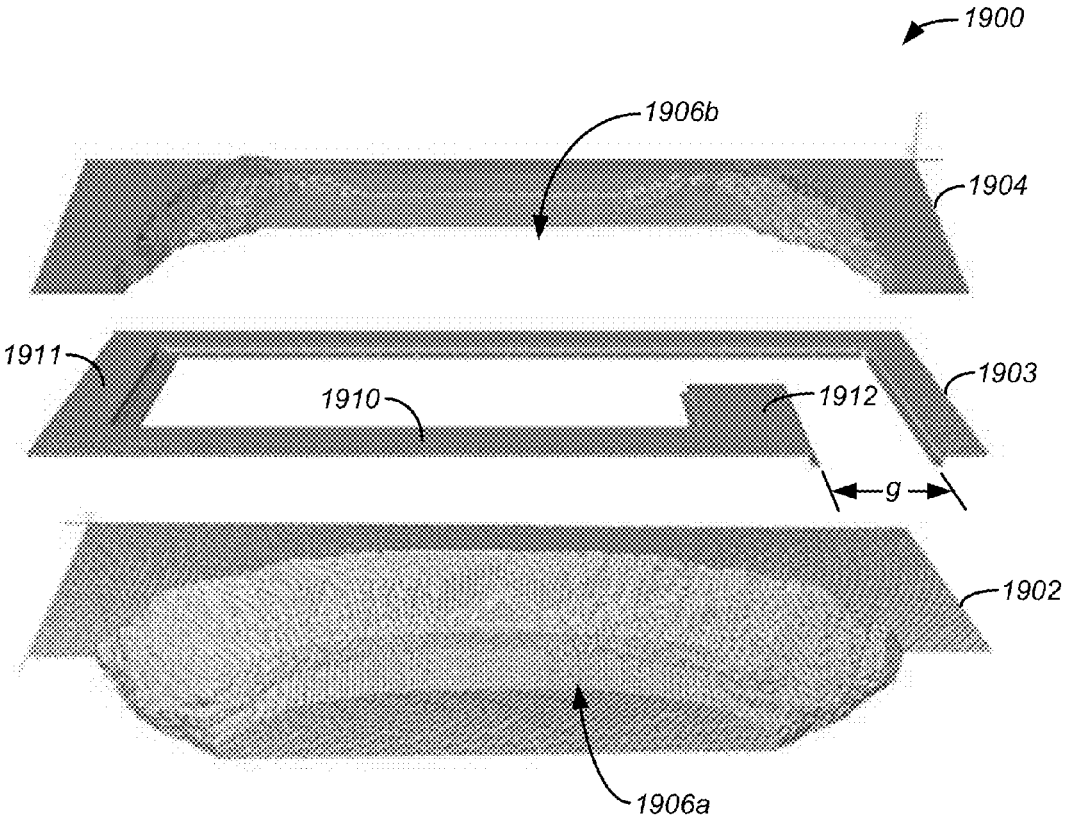
FIG. 20C shows an exploded cross-sectional perspective view of a simulation of an example cavity resonator that includes a lithographically-defined in-plane capacitive tuning structure such as that shown in FIG. 19.

In particular implementations, post structure 1903 also is formed at an array or batch level. For example, in particular implementations, each of the lower cavity portion 1902, the post structure 1903, and the upper cavity portion 1904, is formed at an array-, batch-, or panel-level and subsequently connected with one another at an array-, batch-, or panel-level. FIG. 20C shows an exploded cross-sectional perspective view of a simulation of an example cavity resonator that includes a lithographically-defined in-plane capacitive tuning structure such as that shown in FIG. 19.

In some implementations, the lower mating surface of the post structure substrate is positioned over and connected with the mating surface of the lower cavity portion with an epoxy or other adhesive material layer. In some implementations, the mating surface of the upper cavity portion is positioned over and connected with the upper mating surface of the post structure substrate with an epoxy or other adhesive material layer. In some other implementations, the post structure substrate can be soldered to one or both of the lower cavity portion substrate or the upper cavity portion substrate. In some implementations, the resultant array arrangement can be singulated to provide a plurality of evanescent-mode electromagnetic-wave cavity resonators 1900.

Additionally, using one or more batch processes as, for example, described below, such a lithographically-defined capacitive tuning structure design enables arrays of multiple cavity resonators 1900 each having the same cavity sizes but having potentially different radii of the corresponding post tops 1912 and gap spacings g within the respective cavity resonators 1900. In some implementations, the resonant frequency of the cavity resonator 1900 is generally inversely proportional to the radius of the post top 1912. In such a manner, frequency-determined loading can be set by lithographically-defined dimensions—the gap distance g and the radius of the post top 1912.

Figure 21:
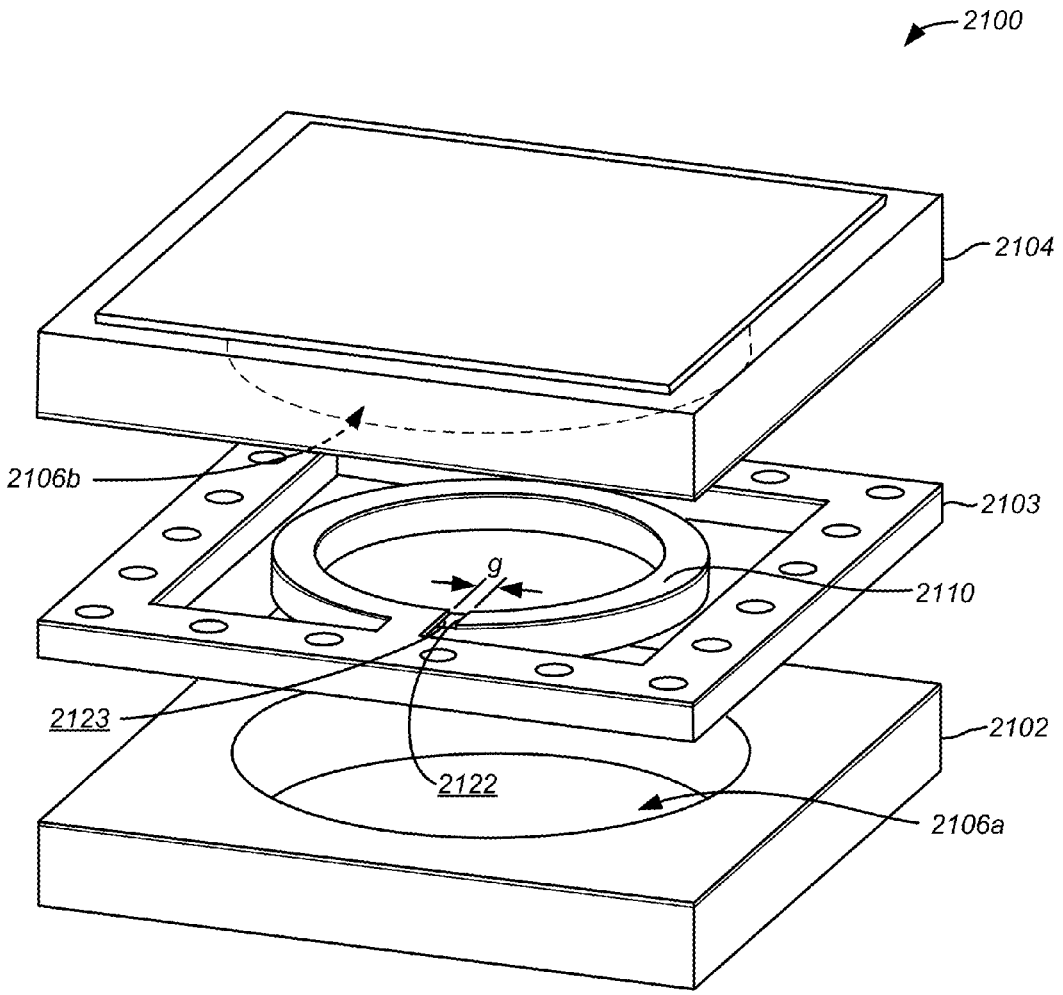
FIG. 21 shows an exploded axonometric view depiction of an example cavity resonator that includes a lithographically-defined in-plane capacitive tuning structure.

FIG. 21 shows an exploded axonometric view depiction of an example cavity resonator 2100 that includes a lithographically-defined in-plane capacitive tuning structure 2110. Unlike the cavity resonator 1900 of FIG. 19, the capacitive tuning structure 2110 is lithographically defined in the form of a suspended split-ring capacitive tuning structure. That is, in some implementations, the capacitive tuning structure 2110 is arranged as a circular structure arranged around and within the cavity formed by the lower and upper cavity volume portions 2106*a* and 2106*b*. The capacitive tuning structure 2110 has a gap spacing g between a distal surface 2122 of the capacitive tuning structure 2110 and a proximal surface 2123 of the capacitive tuning structure 2110. Again, in particular implementations, one or more tuning elements or devices are formed or arranged within the gap spacing g.

Additionally, in particular implementations, each of the lower cavity portion 2102, the capacitive tuning structure 2110, and the upper cavity portion 2104, also is formed at an array level and subsequently connected with one another at an array level. Again, using one or more batch processes, such a lithographically-defined capacitive tuning structure design enables arrays of multiple cavity resonators 2100 each having the same cavity sizes but having potentially different and gap spacings g within the respective cavity resonators 2100.

Figure 22A:
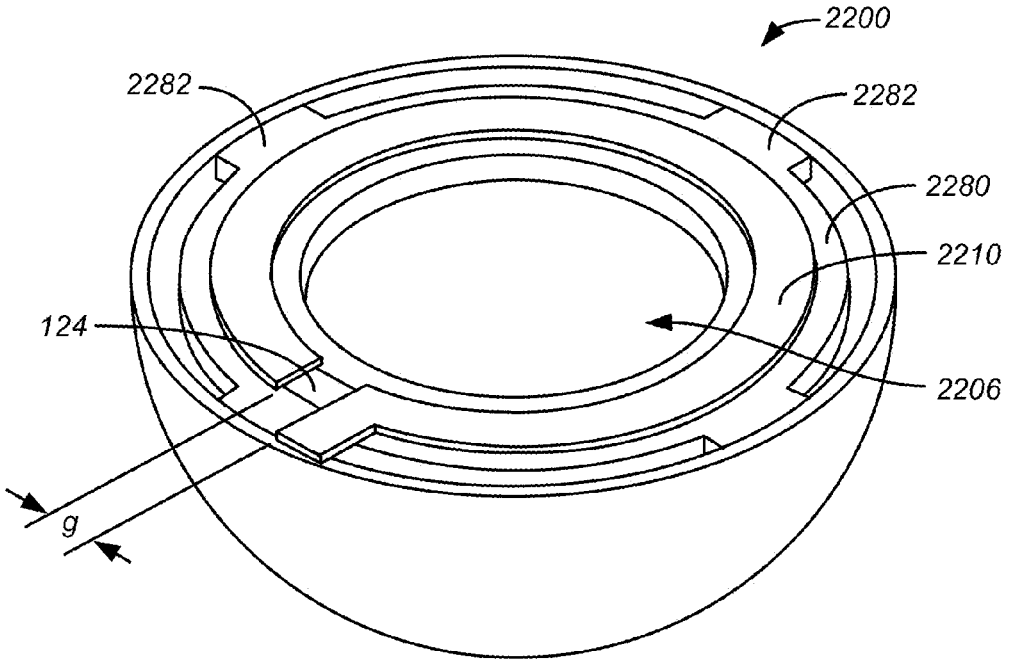
FIG. 22A shows an axonometric cross-sectional top view depiction of an example cavity resonator that includes a lithographically-defined in-plane capacitive tuning structure.
Figure 22B:
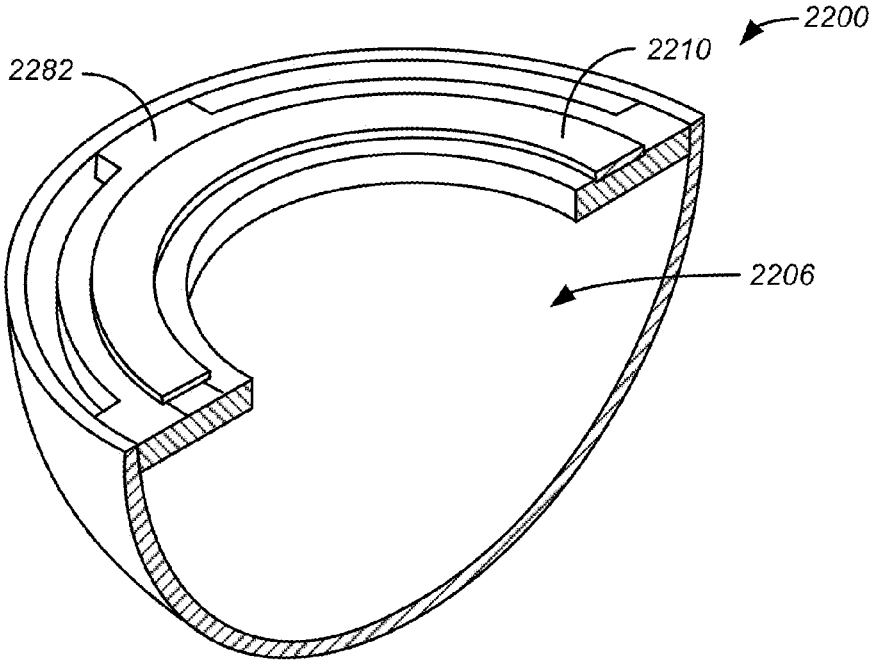
FIG. 22B shows an axonometric cross-sectional side and cross-sectional top view of the example cavity resonator of FIG. 22A.

FIG. 22A shows an axonometric cross-sectional top view depiction of an example cavity resonator 2200 that includes a lithographically-defined in-plane capacitive tuning structure 2210. FIG. 22B shows an axonometric cross-sectional side and cross-sectional top view of the example cavity resonator of FIG. 22A. Like the capacitive tuning structure 2100 of FIG. 21, the capacitive tuning structure 2210 is configured as a split-ring structure arranged within a cavity 2206. However, the cavity resonator 2200 further includes a support member 2280 that can be connected with the surrounding structure with one or more support links 2282.

Figure 23A:
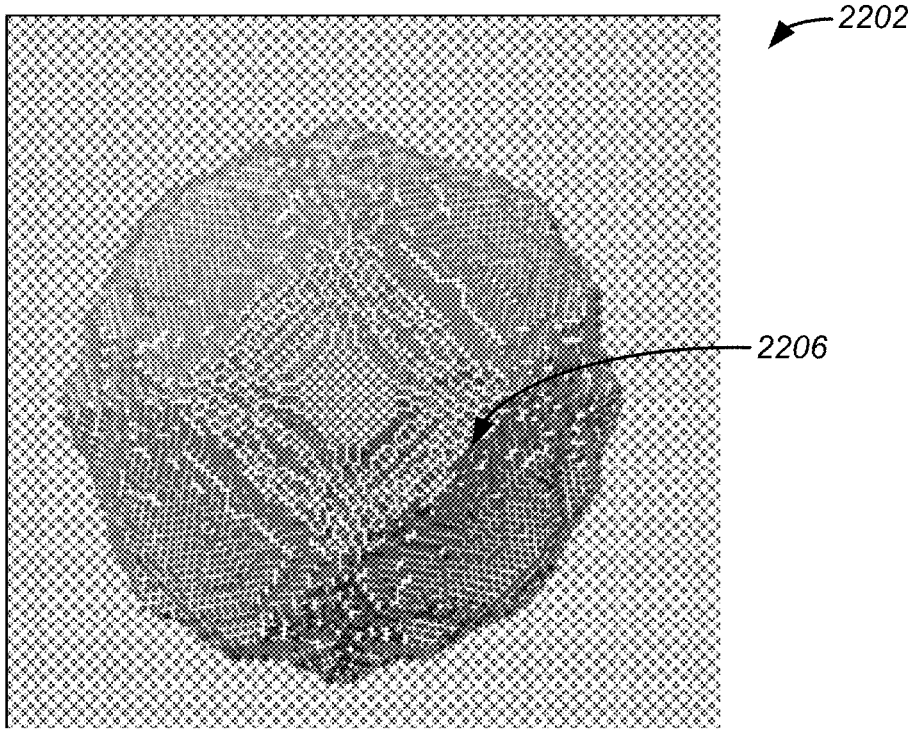
FIG. 23A shows a top view of a simulation of an example lower cavity portion such as that usable in the cavity resonator of FIGS. 22A and 22B.
Figure 23B:
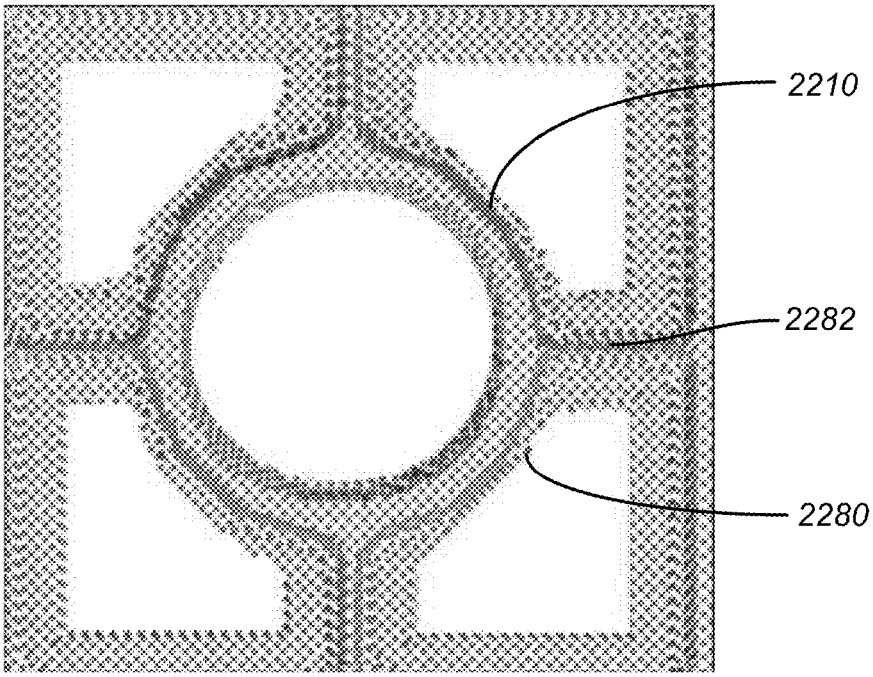
FIG. 23B shows a top view of a simulation of an example lithographically-defined in-plane capacitive tuning structure such as that usable in the cavity resonator of FIGS. 22A and 22B.
Figure 23C:
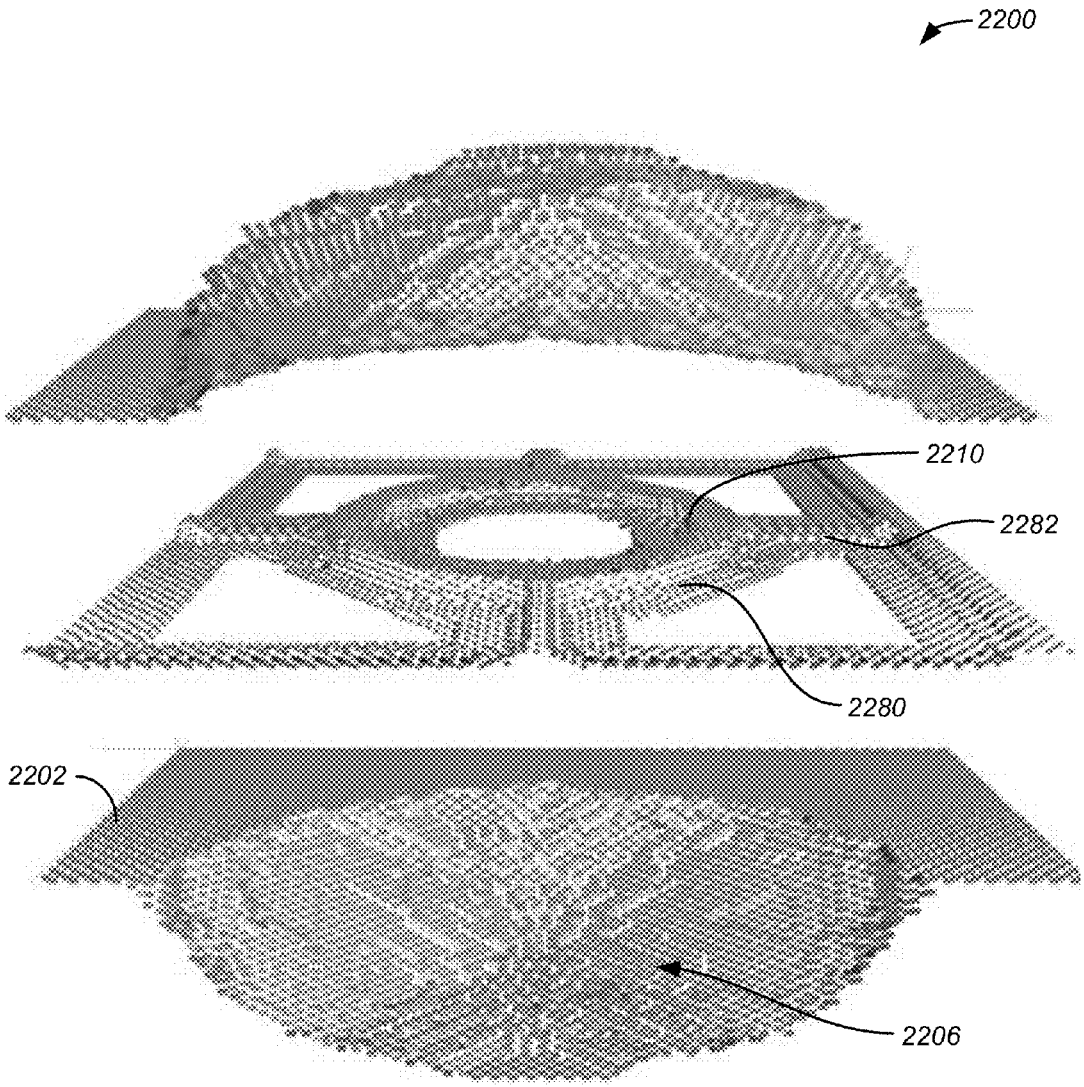
FIG. 23C shows an exploded cross-sectional perspective view of a simulation of an example cavity resonator that includes a lithographically-defined in-plane capacitive tuning structure such as that shown in FIGS. 22A and 22B.

FIG. 23A shows a top view of a simulation of an example lower cavity portion 2202 such as that usable in the cavity resonator 2200 of FIGS. 22A and 22B. FIG. 23B shows a top view of a simulation of an example lithographically-defined in-plane capacitive tuning structure 2210 such as that usable in the cavity resonator 2200 of FIGS. 22A and 22B. FIG. 23C shows an exploded cross-sectional perspective view of a simulation of an example cavity resonator having a support member structure 2280 and one or more support links 2282 such as those shown in FIGS. 22A and 22B.

The described in-plane resonator designs enable a higher (or longer) post to gap aspect ratio as a result of the gap, g, being lithographically-patterned and etched. This design effectively decouples the post height from the overall device thickness as well as simplifies the coupling to planar I/O transmission lines.

The description herein is directed to certain implementations for the purposes of describing the innovative aspects of this disclosure. However, a person having ordinary skill in the art will readily recognize that the teachings herein can be applied in a multitude of different ways. The described implementations may be implemented in any device or system that can be configured to display an image, whether in motion (e.g., video) or stationary (e.g., still image), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, GPS receivers/navigators, cameras, MP3 players, camcorders, game consoles, wrist watches, clocks, calculators, television monitors, flat panel displays, electronic reading devices (i.e., e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS), microelectromechanical systems (MEMS) and non-MEMS applications), aesthetic structures (e.g., display of images on a piece of jewelry) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

An example of a suitable EMS or MEMS device, to which the described implementations may apply, is a reflective display device. Reflective display devices can incorporate interferometric modulators (IMODs) to selectively absorb and/or reflect light incident thereon using principles of optical interference. IMODs can include an absorber, a reflector that is movable with respect to the absorber, and an optical resonant cavity defined between the absorber and the reflector. The reflector can be moved to two or more different positions, which can change the size of the optical resonant cavity and thereby affect the reflectance of the IMOD. The reflectance spectrums of IMODs can create fairly broad spectral bands which can be shifted across the visible wavelengths to generate different colors. The position of the spectral band can be adjusted by changing the thickness of the optical resonant cavity, i.e., by changing the position of the reflector.

Figure 24A:
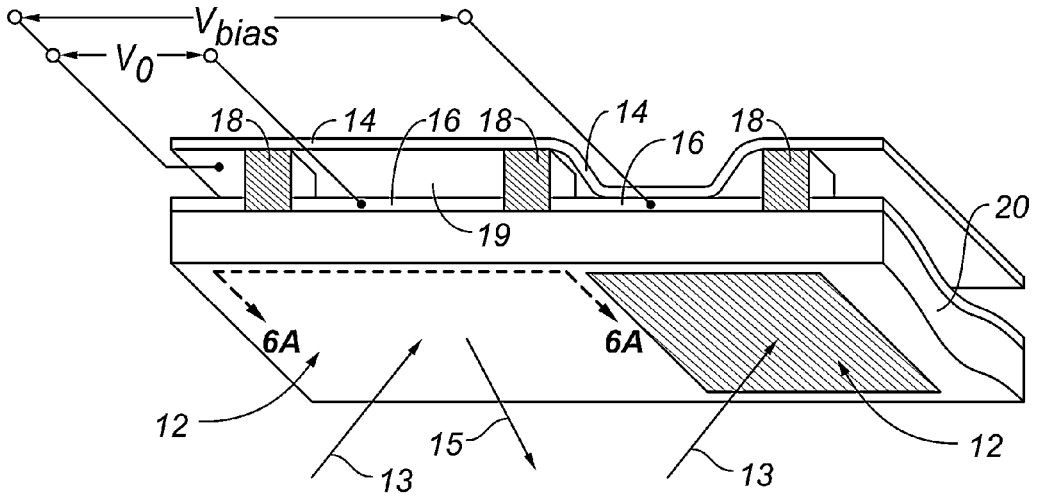
FIG. 24A shows an isometric view depicting two adjacent example pixels in a series of pixels of an example IMOD display device.

FIG. 24A shows an example of an isometric view depicting two adjacent pixels in a series of pixels of an IMOD display device. The IMOD display device includes one or more interferometric MEMS display elements. In these devices, the pixels of the MEMS display elements can be in either a bright or dark state. In the bright ("relaxed," "open" or "on") state, the display element reflects a large portion of incident visible light, e.g., to a user. Conversely, in the dark ("actuated," "closed" or "off") state, the display element reflects little incident visible light. In some implementations, the light reflectance properties of the on and off states may be reversed. MEMS pixels can be configured to reflect predominantly at particular wavelengths allowing for a color display in addition to black and white.

The IMOD display device can include a row/column array of IMODs. Each IMOD can include a pair of reflective layers, i.e., a movable reflective layer and a fixed partially reflective layer, positioned at a variable and controllable distance from each other to form an air gap (also referred to as an optical gap or cavity). The movable reflective layer may be moved between at least two positions. In a first position, i.e., a relaxed position, the movable reflective layer can be positioned at a relatively large distance from the fixed partially reflective layer. In a second position, i.e., an actuated position, the movable reflective layer can be positioned more closely to the partially reflective layer. Incident light that reflects from the two layers can interfere constructively or destructively depending on the position of the movable reflective layer, producing either an overall reflective or non-reflective state for each pixel. In some implementations, the IMOD may be in a reflective state when unactuated, reflecting light within the visible spectrum, and may be in a dark state when unactuated, reflecting light outside of the visible range (such as infrared light). In some other implementations, however, an IMOD may be in a dark state when unactuated, and in a reflective state when actuated. In some implementations, the introduction of an applied voltage can drive the pixels to change states. In some other implementations, an applied charge can drive the pixels to change states.

The depicted portion of the pixel array in FIG. 24A includes two adjacent IMODs 12. In the IMOD 12 on the left (as illustrated), a movable reflective layer 14 is illustrated in a relaxed position at a predetermined distance from an optical stack 16, which includes a partially reflective layer. The voltage V0 applied across the IMOD 12 on the left is insufficient to cause actuation of the movable reflective layer 14. In the IMOD 12 on the right, the movable reflective layer 14 is illustrated in an actuated position near or adjacent the optical stack 16. The voltage Vbias applied across the IMOD 12 on the right is sufficient to maintain the movable reflective layer 14 in the actuated position.

In FIG. 24A, the reflective properties of pixels 12 are generally illustrated with arrows 13 indicating light incident upon the pixels 12, and light 15 reflecting from the IMOD 12 on the left. Although not illustrated in detail, it will be understood by one having ordinary skill in the art that most of the light 13 incident upon the pixels 12 will be transmitted through the transparent substrate 20, toward the optical stack 16. A portion of the light incident upon the optical stack 16 will be transmitted through the partially reflective layer of the optical stack 16, and a portion will be reflected back through the transparent substrate 20. The portion of light 13 that is transmitted through the optical stack 16 will be reflected at the movable reflective layer 14, back toward (and through) the transparent substrate 20. Interference (constructive or destructive) between the light reflected from the partially reflective layer of the optical stack 16 and the light reflected from the movable reflective layer 14 will determine the wavelength(s) of light 15 reflected from the IMOD 12.

The optical stack 16 can include a single layer or several layers. The layer(s) can include one or more of an electrode layer, a partially reflective and partially transmissive layer and a transparent dielectric layer. In some implementations, the optical stack 16 is electrically conductive, partially transparent and partially reflective, and may be fabricated, for example, by depositing one or more of the above layers onto a transparent substrate 20. The electrode layer can be formed from a variety of materials, such as various metals, for example indium tin oxide (ITO). The partially reflective layer can be formed from a variety of materials that are partially reflective, such as various metals, e.g., chromium (Cr), semiconductors, and dielectrics. The partially reflective layer can be formed of one or more layers of materials, and each of the layers can be formed of a single material or a combination of materials. In some implementations, the optical stack 16 can include a single semi-transparent thickness of metal or semiconductor which serves as both an optical absorber and conductor, while different, more conductive layers or portions (e.g., of the optical stack 16 or of other structures of the IMOD) can serve to bus signals between IMOD pixels. The optical stack 16 also can include one or more insulating or dielectric layers covering one or more conductive layers or a conductive/absorptive layer.

In some implementations, the layer(s) of the optical stack 16 can be patterned into parallel strips, and may form row electrodes in a display device as described further below. As will be understood by one having skill in the art, the term "patterned" is used herein to refer to masking as well as etching processes. In some implementations, a highly conductive and reflective material, such as aluminum (Al), may be used for the movable reflective layer 14, and these strips may form column electrodes in a display device. The movable reflective layer 14 may be formed as a series of parallel strips of a deposited metal layer or layers (orthogonal to the row electrodes of the optical stack 16) to form columns deposited on top of posts 18 and an intervening sacrificial material deposited between the posts 18. When the sacrificial material is etched away, a defined gap 19, or optical cavity, can be formed between the movable reflective layer 14 and the optical stack 16. In some implementations, the separation between posts 18 may be approximately 1-1000 um, while the gap 19 may be less than 10,000 Angstroms (Å).

In some implementations, each pixel of the IMOD, whether in the actuated or relaxed state, is essentially a capacitor formed by the fixed and moving reflective layers. When no voltage is applied, the movable reflective layer 14 remains in a mechanically relaxed state, as illustrated by the IMOD 12 on the left in FIG. 24A, with the gap 19 between the movable reflective layer 14 and optical stack 16. However, when a potential difference, e.g., voltage, is applied to at least one of a selected row and column, the capacitor formed at the intersection of the row and column electrodes at the corresponding pixel becomes charged, and electrostatic forces pull the electrodes together. If the applied voltage exceeds a threshold, the movable reflective layer 14 can deform and move near or against the optical stack 16. A dielectric layer (not shown) within the optical stack 16 may prevent shorting and control the separation distance between the layers 14 and 16, as illustrated by the actuated IMOD 12 on the right in FIG. 24A. The behavior is the same regardless of the polarity of the applied potential difference. Though a series of pixels in an array may be referred to in some instances as "rows" or "columns," a person having ordinary skill in the art will readily understand that referring to one direction as a "row" and another as a "column" is arbitrary. Restated, in some orientations, the rows can be considered columns, and the columns considered to be rows. Furthermore, the display elements may be evenly arranged in orthogonal rows and columns (an "array"), or arranged in non-linear configurations, for example, having certain positional offsets with respect to one another (a "mosaic"). The terms "array" and "mosaic" may refer to either configuration. Thus, although the display is referred to as including an "array" or "mosaic," the elements themselves need not be arranged orthogonally to one another, or disposed in an even distribution, in any instance, but may include arrangements having asymmetric shapes and unevenly distributed elements.

Figure 24B:
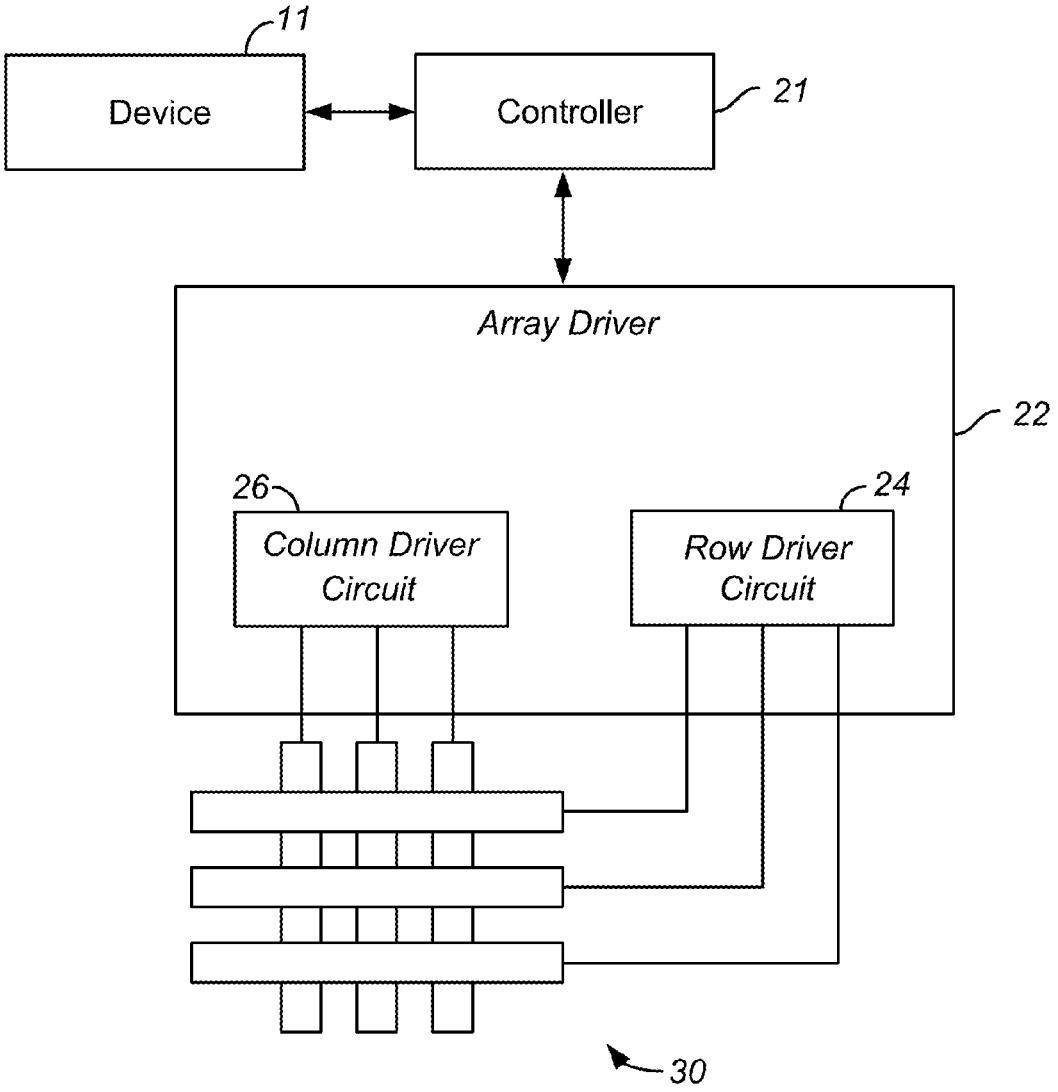
FIG. 24B shows an example system block diagram depicting an example electronic device incorporating an IMOD display.

FIG. 24B shows an example of a system block diagram depicting an electronic device incorporating a 3×3 IMOD display. The electronic device depicted in FIG. 24B represents one implementation in which a piezoelectric resonator transformer constructed in accordance with the implementations described above with respect to FIGS. 1-23 can be incorporated. The electronic device in which device 11 is incorporated may, for example, form part or all of any of the variety of electrical devices and electromechanical systems devices set forth above, including both display and non-display applications.

Here, the electronic device includes a controller 21, which may include one or more general purpose single- or multi-chip microprocessors such as an ARM®, Pentium®, 8051, MIPS®, Power PC®, or ALPHA®, or special purpose microprocessors such as a digital signal processor, microcontroller, or a programmable gate array. Controller 21 may be configured to execute one or more software modules. In addition to executing an operating system, the controller 21 may be configured to execute one or more software applications, including a web browser, a telephone application, an email program, or any other software application.

The controller 21 is configured to communicate with device 11. The controller 21 also can be configured to communicate with an array driver 22. The array driver 22 can include a row driver circuit 24 and a column driver circuit 26 that provide signals to, e.g., a display array or panel 30. Although FIG. 24B shows a 3×3 array of IMODs for the sake of clarity, the display array 30 may contain a very large number of IMODs, and may have a different number of IMODs in rows than in columns, and vice versa. Controller 21 and array driver 22 may sometimes be referred to herein as being "logic devices" and/or part of a "logic system."

Figure 25A:
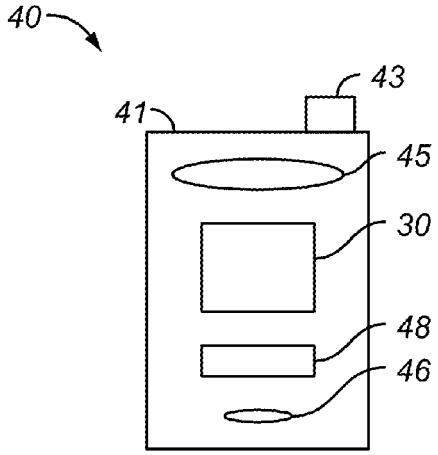
FIGS. 25A and 25B show examples of system block diagrams depicting an example display device that includes a plurality of IMODs.
Figure 25B:
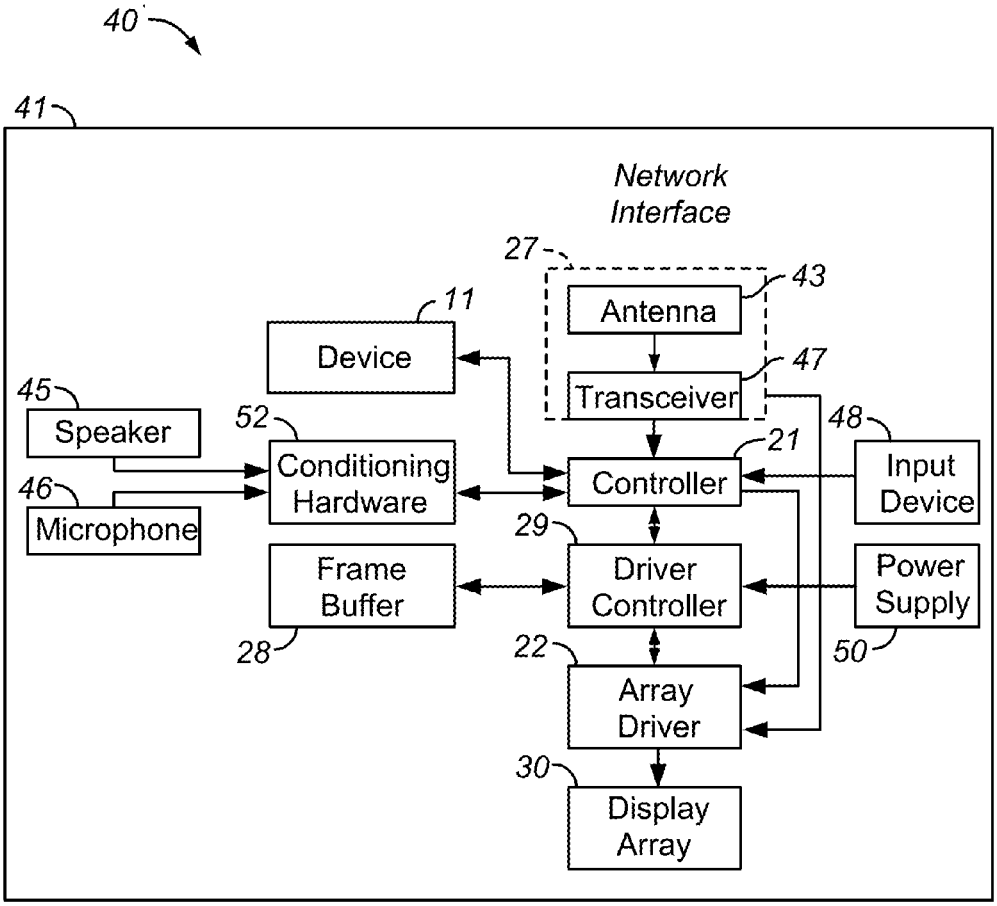

FIGS. 25A and 25B show examples of system block diagrams depicting a display device 40 that includes a plurality of IMODs. The display device 40 can be, for example, a smart phone, a cellular or mobile telephone. However, the same components of the display device 40 or slight variations thereof are also illustrative of various types of display devices such as televisions, tablets, e-readers, hand-held devices and portable media players.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, EL, OLED, STN LCD, or TFT LCD, or a non-flat-panel display, such as a CRT or other tube device. In addition, the display 30 can include an IMOD display, as described herein.

The components of the display device 40 are schematically illustrated in FIG. 25B. The display device 40 includes a housing 41 and can include additional components at least partially enclosed therein. For example, the display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g., filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the BLUETOOTH standard. In the case of a cellular telephone, the antenna 43 is designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G or 4G technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that is readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of pixels.

In some implementations, the driver controller 29, the array driver 22, and the display array 30 are appropriate for any of the types of displays described herein. For example, the driver controller 29 can be a conventional display controller or a bi-stable display controller (such as an IMOD controller). Additionally, the array driver 22 can be a conventional driver or a bi-stable display driver (such as an IMOD display driver). Moreover, the display array 30 can be a conventional display array or a bi-stable display array (such as a display including an array of IMODs). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

The various illustrative logics, logical blocks, modules, circuits and algorithm steps described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and steps described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular steps and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the IMOD as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A device comprising:

an evanescent-mode electromagnetic-wave cavity resonator including:

a first dielectric cavity portion including a cavity operable to support at least one evanescent electromagnetic wave mode, the first cavity portion including an inner cavity surface defining the cavity;

a first conductive layer on the inner cavity surface;

a second cavity portion adjacent the first cavity portion, the second cavity portion including a cavity ceiling surface defining a ceiling of the cavity;

a dielectric post structure extending distally away from a central region of the inner cavity surface towards the cavity ceiling surface, a distal surface of the post structure being separated from the cavity ceiling surface by a gap distance, a resonant frequency of the at least one evanescent electromagnetic wave mode being dependent at least partially on the gap distance;

a second conductive layer on the post structure;

at least one dielectric spacer in a first region between the distal surface of the post structure and the cavity ceiling surface, the at least one dielectric spacer defining a static portion of the gap distance; and at least one tuning element between the distal surface of the post structure and the cavity ceiling surface, the at least one tuning element including:

a first portion or first tuning element that physically couples the cavity ceiling surface with the at least one dielectric spacer in the first region, and a second portion or second tuning element that includes at least one microelectromechanical systems (MEMS) structure actuatable to adjust a capacitance across the gap distance in a second region outside of the first region to effect a change in the resonant frequency of the at least one evanescent electromagnetic wave mode.

2. The device of claim 1, wherein the cavity is substantially hemispheric.

3. The device of claim 1, wherein the cavity is of a shape that is characteristically like a half of an ellipsoid wherein a mating surface of the isotropically-etched cavity is coplanar with a plane parallel to both the major axis and the minor axis of the half of the ellipsoid.

4. The device of claim 1, wherein:

the inner cavity surface of the cavity has a first approximately planar inner bottom surface parallel to a mating surface of the cavity; and the inner cavity surface of the cavity has a second curved inner side surface that connects the mating surface of the isotropically-etched cavity with the first planar inner bottom surface.

5. The device of claim 1, wherein the cavity includes a first cavity and a second cavity having a mating surface that is coplanar with a mating surface of the first cavity, a circumference of the first cavity overlapping a circumference of the second cavity.

6. The device of claim 1, wherein the post structure has a circular or elliptical cross-section.

7. The device of claim 1, wherein the post structure is integrally connected with the first cavity portion.

8. The device of claim 1, the post structure including a post and a post top at the distal end of the post, the post top being concentric with the post and having a radius or width larger than a corresponding radius or width of the post.

9. The device of claim 8, wherein:

the post structure has a height in the range of approximately 100 microns (μm) to approximately 1000 μm;

the post has a width or diameter in the range of approximately 0.1 millimeters (mm) to approximately 1 mm; and the post top has a width or diameter in the range of approximately 0.2 mm to approximately 5.0 mm.

10. The device of claim 1, wherein the at least one MEMS structure includes at least two MEMS structures, each of the at least two MEMS structure being selectively actuatable.

11. The device of claim 1, wherein the at least MEMS structure is electrostatically-actuatable.

12. The device of claim 1, wherein the at least MEMS structure element is piezoelectrically-actuatable.

13. The device of claim 1, further including:

a display;

a processor configured to communicate with the display, the processor being configured to process image data; and a memory device configured to communicate with the processor.

14. The device of claim 13, further including:

a driver circuit configured to send at least one signal to the display; and a controller configured to send at least a portion of the image data to the driver circuit.

15. The device of claim 1, wherein the gap distance is fixed in length.

16. The device of claim 1, wherein the at least one MEMS structure is actuatable to adjust a length of the gap distance to adjust the capacitance across the gap distance.

17. A device comprising:

an evanescent-mode electromagnetic-wave cavity resonating means including:

a first dielectric cavity means operable to support at least one evanescent electromagnetic wave mode, the first cavity means including an inner cavity surface defining the cavity;

a first conductive means on the inner cavity surface;

a second cavity means adjacent the first cavity means, the second cavity means including a cavity ceiling surface defining a ceiling of the cavity;

a dielectric capacitive tuning means extending distally away from a central region of the inner cavity surface towards the cavity ceiling surface, a distal surface of the capacitive tuning means being separated from the cavity ceiling surface by a gap distance, a resonant frequency of the at least one evanescent electromagnetic wave mode being dependent at least partially on the gap distance;

a second conductive means on the capacitive tuning means;

at least one dielectric spacer means in a first region between the distal surface of the capacitive tuning means and the cavity ceiling surface, the at least one dielectric spacer means defining a static portion of the gap distance; and at least one actuatable tuning means between the distal surface of the capacitive tuning means and the cavity ceiling surface, the at least one actuatable tuning means including:

a first portion or first tuning element that physically couples the cavity ceiling surface with the at least one dielectric spacer means in the first region, and a second portion or second tuning element that includes at least one microelectromechanical systems (MEMS) structure actuatable to adjust a capacitance across the gap distance in a second region outside of the first region to effect a change in the resonant frequency of the at least one evanescent electromagnetic wave mode.

18. The device of claim 17, wherein the capacitive tuning means is integrally connected with the first cavity means.

19. The device of claim 17, the capacitive tuning means including a post and a post top at the distal end of the post, the post top being concentric with the post and having a radius or width larger than a corresponding radius or width of the post.

20. The device of claim 17, wherein the capacitive tuning means has a circular or elliptical cross-section.

21. The device of claim 17, wherein the at least one MEMS structure includes at least two MEMS structures, each of the at least two MEMS structures being selectively actuatable.

22. The device of claim 17, wherein the at least one MEMS structure is electrostatically-actuatable.

23. The device of claim 17, wherein the at least one MEMS structure is piezoelectrically-actuatable.

24. The device of claim 17, wherein the gap distance is fixed in length.

25. The device of claim 17, wherein the at least one MEMS structure is actuatable to adjust a length of the gap distance to adjust the capacitance across the gap distance.

* * * * *